US009453459B2

(12) United States Patent
Horsch

(10) Patent No.: US 9,453,459 B2
(45) Date of Patent: Sep. 27, 2016

(54) INTERNAL COMBUSTION ENGINE

(71) Applicant: Joachim Horsch, Lombard, IL (US)

(72) Inventor: Joachim Horsch, Lombard, IL (US)

( * ) Notice: Subject to any disclaimer, the term of this patent is extended or adjusted under 35 U.S.C. 154(b) by 142 days.

(21) Appl. No.: 14/564,716

(22) Filed: Dec. 9, 2014

(65) Prior Publication Data

US 2015/0167547 A1 Jun. 18, 2015

Related U.S. Application Data

(60) Provisional application No. 61/913,534, filed on Dec. 9, 2013.

(51) Int. Cl.

| | |
|---|---|
| ***F02B 75/26*** | (2006.01) |
| ***F02B 75/28*** | (2006.01) |
| ***F01B 3/00*** | (2006.01) |
| ***F01B 3/02*** | (2006.01) |
| ***F01B 7/02*** | (2006.01) |

(52) U.S. Cl.

CPC ..... *F02B 75/26* (2013.01); *F01B 3/0005* (2013.01); *F01B 3/02* (2013.01); *F01B 7/02* (2013.01); *F02B 75/282* (2013.01)

(58) Field of Classification Search

CPC ..... F04B 1/324; F04B 1/20; F04B 1/146; F04B 1/2085; F04B 1/26; F04B 1/295; F04B 23/06; F04B 27/1072; F04B 1/0413; F04B 27/086; F04B 27/12; F04B 27/18; F04B 5/02; F02B 75/26; F01B 3/02; F01B 3/007; F01B 3/0073; F01B 7/02; F01B 7/04; F01B 7/16

USPC ..... 123/56.3, 52.1, 52.5, 56.1, 56.2, 59.7, 123/56.6, 53.3, 53.6, 55.5, 55.2, 55.7, 55.6

See application file for complete search history.

(56) References Cited

U.S. PATENT DOCUMENTS

| | | | | |
|---|---|---|---|---|
| 1,555,165 | A | 9/1925 | Sherman | |
| 1,978,194 | A | 10/1934 | Gray | |
| 2,776,649 | A | 1/1957 | Fenske | |
| 3,536,050 | A * | 10/1970 | Denis | F01B 3/0005 123/51 A |
| 3,901,093 | A * | 8/1975 | Brille | F01B 3/02 123/56.4 |
| 4,129,102 | A * | 12/1978 | van der Lely | F01B 3/0005 123/51 B |
| 7,117,828 | B2 | 10/2006 | Shuttleworth | |
| 7,509,930 | B2 | 3/2009 | duPont | |
| 7,650,829 | B2 * | 1/2010 | Beck | B23P 15/10 29/888.04 |
| 8,230,827 | B2 | 7/2012 | Jaquet | |
| 2007/0081904 | A1 * | 4/2007 | Kurita | F04B 27/1054 417/269 |
| 2007/0295008 | A1 * | 12/2007 | Shuttleworth | F02B 75/26 60/605.2 |

(Continued)

OTHER PUBLICATIONS

International Searching Authority; International Search Report regarding International PCT/US2015/064179; Feb. 11, 2016; 3 pages.

(Continued)

*Primary Examiner* — Lindsay Low
*Assistant Examiner* — Long T Tran
(74) *Attorney, Agent, or Firm* — Law Office of John W. Harbst

(57) ABSTRACT

A two-cycle internal combustion engine having two swash plate mechanisms with multiple pistons sets disposed therebetween. With each piston set including an opposed piston arrangement and wherein torque reaction to the output torque is transmitted to a housing of the engine through bevel gears and wherein major loads generated during engine operation are carried by a bearing arrangement.

43 Claims, 16 Drawing Sheets

(56) References Cited

U.S. PATENT DOCUMENTS

2008/0190398 A1* 8/2008 Geirnaert ..... F01B 3/0005
123/51 R
2010/0247338 A1* 9/2010 Hutto, Jr. ..... F04B 1/143
417/269

OTHER PUBLICATIONS

International Searching Authority; International Written Opinion regarding International PCT/US2015/064170; Feb. 11, 2016; 8 pages.

* cited by examiner

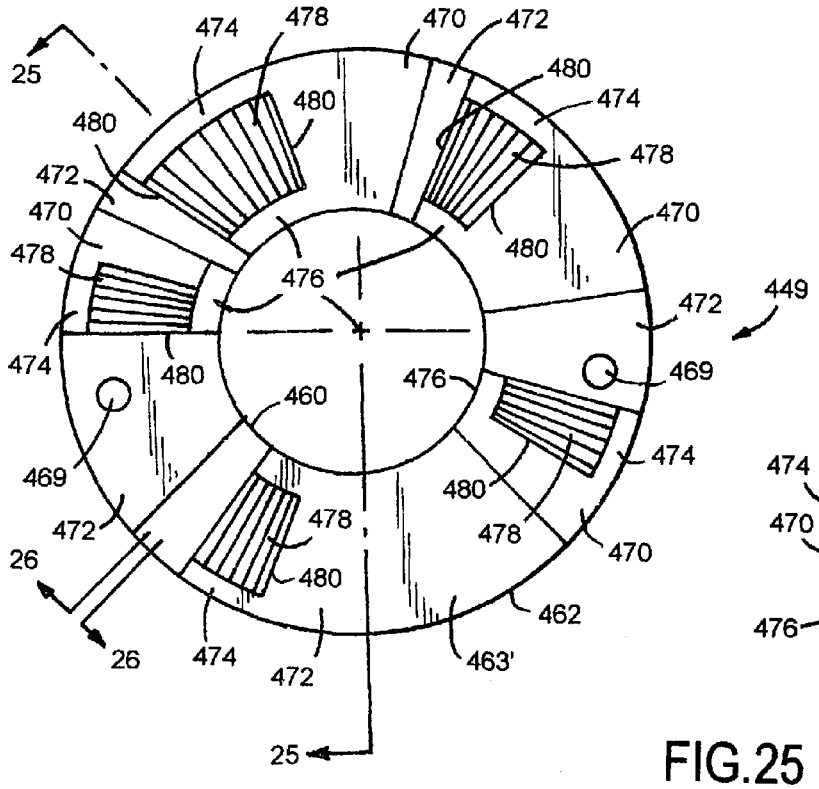
FIG.24
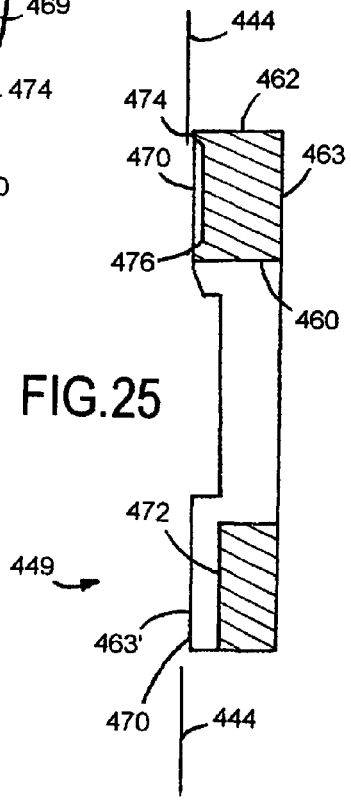
FIG.25
FIG.26
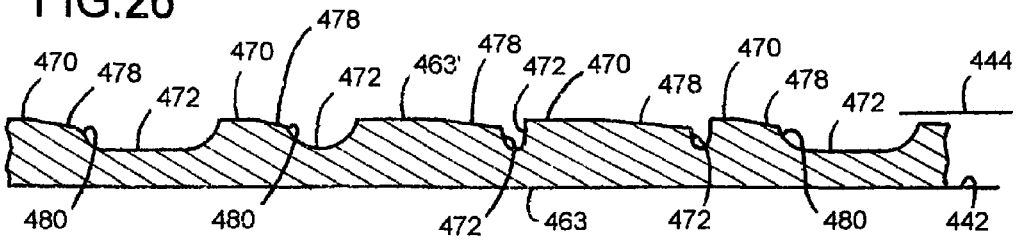

INTERNAL COMBUSTION ENGINE

RELATED APPLICATION

This patent application claims the benefit of my copending earlier filed U.S. provisional patent application, Ser. No. 61/913,534 filed Dec. 9, 2013.

FIELD OF THE INVENTION DISCLOSURE

The present invention disclosure generally relates to internal combustion engines and, more specifically, to a two-cycle internal combustion engine utilizing a pair of swash plate mechanisms.

BACKGROUND

Reciprocating motion can be converted into rotating motion through several different devices. As an example, reciprocating motion can be converted into rotating motion through a crank. In this type of device, the reciprocating motion is perpendicular to the axis of rotation. Alternatively, a "cam" type device can be used to convert reciprocating motion into rotating motion. In this later device, the cam wobbles on a rotating shaft and produces an axial reciprocating motion in the direction of the rotating axis. In this later device, the linear or reciprocating movement is parallel to the rotating axis.

In the description which follows, a swash or wobble plate engine is disclosed and can be characterized as an engine which utilizes a "cam" type mechanism.

Two-cycle engines are defined as engines with one power stroke per revolution rather than one power stroke every other revolution as in 4 cycle engines.

There are two types of opposed piston engines which include a swash plate. One engine type has a crank shaft or swash plate located between two opposed pistons. In this first engine type, each piston operates in a separate cylinder. The second engine type has two crank shafts or two swash plate mechanisms, with two opposed pistons sharing one cylinder located between the two crank shafts or two swash plate mechanisms. The internal combustion engine disclosed herein involves an opposed piston engine of the second type.

As used herein and throughout, the phrases "T.D.C." and "B.D.C" refer to the extreme position of the piston in the cylinder at top and at bottom respectively. As used herein and throughout, the term or phrase "normal operating speed" refers to an average speed in the normal operating range. Thus, if the engine normally operates in a range from 1900 to 2600 rpm the normal operating speed would be 2250 rpm.

The swash plate mechanism of an internal combustion engine converts the reciprocating motion into a rotating motion by a cam. The cam in the form of a rotating disc fixed to a rotatable shaft at an angle to produce an inclined plane with respect to the centerline of the shaft. A non-rotating disc is in contact with the rotating surface on the angled rotatable shaft through a bearing. As the shaft rotates, the non-rotating disc wobbles. A mechanism is required to keep the non-rotating disc from rotating. A variety of mechanisms are known such as sliding bearings, linkages, universal joints, and bevel gears to allow motion between the discs and to keep the non-rotating disc from rotating.

Any point on the non-rotating disc moves back and forth essentially thru a circular arc in the direction of the axis of the shaft. Thus, a piston in linear motion parallel to the shaft, can operate against a point on the non-rotating disc thru a connecting rod assembly having ball joints at opposed ends.

The ball joints are necessary to accommodate the slight non-planar motion of the center of the ball joint on the non-rotating disc with respect to the center of the ball joint in the piston. The angular displacement of one ball joint with respect to the other varies from positive to negative depending on the angle of rotation of the engine Internal combustion engines having one or more swash plates are known in the prior art. A serious problem with the prior art devices, however, involves how to deal with the relatively large forces generated during engine operation. The prior art has yet to develop an economical version of an internal combustion engine which utilizes swash plate technology and which is operational at relatively high speeds.

Swash plate mechanisms are used in compressors, hydraulic pumps and motors. These devices with swash plate mechanisms are widely used in industry, while engines with swash mechanisms are not. The reasons why swash plate technology are not used in internal combustion engines is both numerous and complex. First, the efficiency of sliding bearings used in pumps is low. This effect is accentuated in internal combustion engines. Second, if antifriction bearings are proposed, their load capacity is limited due to their proposed location within the engine and their installation is difficult. Larger bearings (unless they are located properly within the design) tend to increase the size of the engine and, thus, the acceleration forces which require still larger bearings. Thus, the speed of the engine in these proposals is limited due to the acceleration forces. Moreover, the mechanism for transmitting torque reactions from the non-rotating disc to the engine housing is difficult and space consuming. Proposals range from sliding mechanisms, to linkages, to U-joints, to small diameter bevel gears. Bevel gears are commonly used in swash plate compressors with relatively low pressure. They are small diameter gears located at the intersection of the axis of rotation of the main shaft and the axis of relative rotation of the bearing between the two swash plates. A high power density engine would need much larger diameter gears. These and other related problems make the swash plate engine uninteresting.

Most engines in the passenger car and truck industry are using a four cycle, crankshaft type system. Four-cycle engines, as opposed to two-cycle engines, however, require expensive valve systems including separate cylinder heads and in most cases separate intake and exhaust manifolds.

The following is a non-exhaustive list of reasons why two-cycle, crank type engines are not common. First, fuel needs and special lubricant additives which cause pollution during operation of a two-cycle engine is a drawback to two-cycle engine designs and are an inconvenience for the operator. Second, the gas exchange between the exhaust gas and the intake gas is inefficient in two-cycle engine designs whereby causing pollution and higher fuel consumption. This is due to the fact that the inlet port and the exhaust port are both located in relative proximity near the BDC of the piston. Thus, mixing of exhaust gas and intake gas is inevitable. Also, the timing of the various port openings and closings is compromised, as the exhaust port must open first to allow the pressure in the cylinder to drop to intake pressure before the intake port opens. Consequentially the intake port closes first before the exhaust port closes. This inherent timing prevents the filling of the cylinder to an intake pressure higher than the average exhaust pressure. Moreover, multi-cylinder two-cycle engines require a turbo charger or a compressor. An engine driven compressor causes significant losses and is generally ruled out for cars and trucks. Use of a turbo charger, however, is compromised since the timing problem mentioned above is accentuated. Some car and truck engines use a "pulse" type turbo charger which takes advantage of the kinetic energy in the exhaust, and keeps the average exhaust pressure lower than the intake pressure. But the inherent timing problem will not allow the fill pressure in the cylinder to exceed the exhaust pressure and, therefore, the turbo charger is not fully utilized. The present invention disclosure presents a two-cycle opposed piston design in combination with a swash plate mechanism which addresses and offers a unique solution to these heretofore known problems with two-cycle engines.

In general, crankshaft type, multi cylinder engines use journal bearings to carry the loads, since it is difficult to install antifriction bearings. One of the known problems with journal bearings, however, is that they have higher friction, thus, fuel consumption is increased. Also, in crank shaft type engines, the torque reaction of the output torque is transmitted to the housing through the piston pushing against the cylinder wall causing significant losses translating to higher fuel consumption.

Swash plate engine designs have been proposed before, but they have not found acceptance. Their acceptance in industry was largely hindered because of bearing problems and inefficiencies related to friction in sliding bearings. Also strength problems in the components within a compact design had a detrimental effect on their wide spread acceptance.

Use of antifriction bearings do not offer adequate capacity for high power density applications. Also, the torque reaction of the engine has heretofore been dealt with inadequately with proposals of sliding mechanisms, universal joints, linkages and small diameter bevel gears, which would not have sufficient capacity. Two-cycle opposed piston crank type engines, in which two pistons share the same cylinder, are also known in the art, but they were of the crank type and it would be cumbersome and space consuming to interconnect the two crank shafts.

SUMMARY

In view of the above, and in accordance with one aspect of this invention disclosure there is provided an internal combustion engine which advantageously combines a swash plate mechanism design embodying an opposed piston design in a multi-cylinder engine. The internal combustion engine disclosed herein is expected to have a lower cost of production, lower fuel consumption and is more compact in overall size and weight than known four-cycle crank type engine designs.

In accordance with one aspect of this invention disclosure, the internal combustion engine includes a main housing along with first and second swash plate mechanisms arranged in axially spaced relation relative to each other. The swash plate mechanisms are operated by a shaft assembly arranged in the housing for rotation about a fixed longitudinal axis and including two angular cranks. The angular cranks of the swash plate mechanisms are interconnected by the shaft assembly and maintain a fixed angular index between the first and second swash plate mechanisms. Each swash plate mechanism further includes a rotating surface which rotates with the respective crank upon rotation of the shaft assembly and a set of two bevel gears with intermeshing teeth. Each swash plate mechanism also includes a set of annular conical surface bearings, and a non-rotating disc. In this first family of embodiments, a bearing arrangement including first and second roller contact bearings maintains the non-rotating disc in contact with the rotating surface. The non-rotating disc defines a plurality of spherical sockets arranged in a circular array. The sockets accept and hold therewithin a first ball joint disposed toward a first end of a series of piston rod assemblies. A center of the circular array is disposed on the longitudinal axis of the engine. A plane defined by the circular array of sockets is arranged parallel to the rotational surface of the respective swash plate mechanism.

Multiple axial cylinders are arranged in a circular array within the housing about and extend generally parallel to the longitudinal axis of the engine. The cylinders are radially and preferably equidistantly arranged from the axis of the shaft assembly and between the first and second swash plate mechanisms. A plurality of piston sets are also provided as part of the engine. Each piston set includes first and second pistons.

The pistons are arranged in each axial cylinder for reciprocal movements in opposed directions relative to each other, with the first piston of each piston set being operably connected to the first swash plate mechanism by one of a series of piston rod assemblies, and with the second piston in each piston set being operably connected to said second swash plate mechanism by one of the series of piston rod assemblies. The pistons in each piston set each define a spherical socket which accepts and holds therewithin a second ball joint disposed toward a second end of the series of piston rod assemblies. The pistons in each piston set each include a piston head forming part of a combustion chamber.

A pair of end housings are operably secured to the main housing for rotatably supporting the shaft assembly at opposed ends. A mechanism for producing a pressurized stream of air is also arranged in operable combination with the housing. Moreover, there is provided a system, operably associated with the mechanism for producing a pressurized stream of air, for injecting fuel through an inlet port defined by the main housing and into each cylinder. A pump supplies lubricating and cooling fluid to a lubrication system.

Each piston rod assembly preferably includes an elongated connector extending between and connected to one of the ball joints disposed toward opposed ends thereof. Preferably, the elongated connector of each piston rod assembly is configured as a hollow rod which passes endwise through a first retainer operably associated with one piston and a second retainer operably associated with the non-rotating disc. A tube passes through the hollow rod and is operably connected toward each end to one of the ball joints of the respective piston rod assembly whereby entrapping the connector tube therebetween.

In one form, the first retainer operably holds the ball joint at one end of a respective piston rod assembly in operable association within the spherical socket defined by one of the pistons while the second retainer holds the ball joint at the opposed end of the respective piston rod assembly in operable association with the non-rotating disc. Each retainer preferably has a spherical surface configuration on a first side thereof that contacts a respective ball joint and a generally flat surface on a second side contacting a retaining ring operably fit into a groove on each of the pistons. The retaining ring is preferably selected from a group of retaining rings with a variety of thicknesses so as to produce a snug fit between the ball joint and each of the pistons and the respective retaining ring.

In one embodiment of the present invention disclosure, thrust and radial loads between the rotating surface and said non-rotating disc of each swash plate mechanism are carried by the first rolling contact bearing disposed therebetween in conjunction with the second rolling contact bearing which absorbs the imbalance of forces from the first rolling contact bearing. The first bearing is disposed a greater radial distance from the longitudinal axis of the shaft assembly than is the center of the circular array of spherical sockets on the non-rotating disc such that a diameter of the first bearing is not constrained by the spherical sockets on the non-rotating disc and a line of action of resultant forces from the pistons is disposed proximate to an effective center of the first rolling contact bearing whereby minimizing moments about the effective center of the first bearing.

Preferably, and in an alternative form of this invention disclosure, the first and second rolling contact bearings are of the same design. An effective center of the first rolling contact bearing is disposed relative to the longitudinal axis of the shaft assembly such that the second rolling contact bearing is positioned and has a capacity to absorb a high level of forces during engine operation.

In one form, the annular conical surface bearings absorb a majority of an imbalance of a sum of moments whereby allowing the engine to perform at higher than normal engine speeds. The first annular conical surface bearing is operably attached to the housing and concentrically arranged relative to the longitudinal axis of the engine. The second annular conical surface bearing is attached to the non-rotating surface and concentrically arranged relative to an axis of relative rotation between the rotating surface and the non-rotating disc. The first and second annular conical surface bearings operably contact each other at a line passing through an intersection of the longitudinal axis of the engine and the axis of relative rotation between the rotating surface and the non-rotating disc. In one embodiment, the conical surface bearings encircle the respective swash plate mechanism whereby yielding a relatively large moment arm about an effective center of the conical surface bearings so as to produce a force which counteracts the imbalance of moments generated by accelerating forces at higher than normal engine operating speeds.

Preferably, the set of bevel gears of each swash plate mechanism keeps the non-rotating disc from rotating. A first bevel gear in the set of bevel gears is concentrically arranged relative to the longitudinal axis of the engine and is operably secured to the housing. The second bevel gear in the set of gears is concentrically arranged relative to an axis of relative rotation between the rotating surface and the non-rotating disc and is operably secured to the non-rotating disc. The set of bevel gears are arranged relative to each other such that their apex coincides with an intersection between the longitudinal axis of the engine and the axis of relative rotation between the rotating surface and the non-rotating disc. A diameter of the first and second bevel gears in each set of bevel gears operably surrounds the respective swash plate mechanism.

Locating the first rolling contact bearing behind the action of the piston forces advantageously permits the maximum sum of the moments produced by the pressure forces on the pistons, by centrifugal forces and by the bevel gear forces, about the effective center of the first rolling contact bearing in the direction of the accelerating moments, to be essentially canceled by the moments produced by the sum of the accelerating moments at maximum power and at normal operating speed of the engine, thus minimizing the overall bearing load at operating speed. The second rolling contact bearing absorbs the difference between the maximum sum of the moments about the effective center of the bearing and the sum of the accelerating moments at speeds below normal operating speed.

Preferably, the conical surface bearings of each swash plate mechanism are in line with a pitch cone of the bevel gears to absorb the net acceleration moments generated at moderate to high speeds of the engine. The conical surface bearings are active when the sum of the moments due to the accelerating forces exceeds the maximum sum of the moments, other than the accelerating moments, about the effective center of the bearing.

The piston heads of the first and second pistons of each piston set define a combustion chamber between juxtaposed ends of the first and second pistons. The piston head of each piston set defines an inlet opening through which fuel passes from the injection fuel system for combustion during operation of the engine. Cooling and pressurized lubricant is directed toward each piston head during operation of the engine by the pump. In one form, the piston in each piston set includes a spacer defining at least a portion of the spherical socket defined by each piston. The spacer preferably defines grooves which receive and distribute lubricant from the pump across an inside of the piston head of each set of pistons. In one embodiment, the ball joints of each piston rod assembly also receive lubricant from the pump.

In one form, the shaft assembly is of multipiece construction and includes an axially elongated centershaft with an angular crank releasably secured to each end of the centershaft. As such, the axial distance between the swash plate mechanism can advantageously be adjusted to compensate for tolerance variations between the parts while controlling the compression volume in the cylinders at the smallest distance between the opposed pistons. In one form, one or more fasteners axially pass through the angular crank of each swash plate mechanism to releasably secure the respective crank shaft to an end of the centershaft. In another preferred embodiment, the angular crank of each swash plate mechanism is adjustably secured to the centershaft to allow an axial distance between the juxtaposed ends of the first and second pistons to be adjusted whereby modifying the volume of the combustion chamber.

In a preferred form, the engine includes a porting system designed to improve the gas exchange between the intake and exhaust for a two-cycle engine. This is achieved by using one of the pistons of the opposed pair as an intake piston and the other in the pair as an exhaust piston. The exhaust piston opens the exhaust port at one end of the cylinder while the intake piston opens the intake port at the other end. Thus, the intakes and exhausts are separated by a relatively large distance and the tendency for the mixing of the gases is reduced, since there is no counter flow of the two gases. An added benefit is that both ports can be made larger as the total circumference of the cylinder is available for spaced holes or slots rather than only about one-third of the circumference of a conventional two-cycle engine.

In a preferred embodiment of this invention disclosure, the timing of the port openings and closings is advantageously optimized. This is accomplished by providing the following sequence: first the exhaust port opens to drop the cylinder pressure to slightly below the intake pressure, then the intake port opens to bring in fresh gas forcing out the residual exhaust gas, then the exhaust port closes before the inlet port to provide some time for pressure equalization between the intake pressure and the cylinder pressure. This sequence is achieved by an index lag between the intake piston and the exhaust piston.

Preferably, an inlet or opening is defined between the combustion chamber and a side of each piston. The angular disposition of the opening preferably corresponds to area between two openings in the respective cylinder so as to prevent premature opening of the inlet port defined by said housing during operation of said engine. In one embodiment, a portion of the circumferential edge arranged toward a foremost end of each piston defines a series of angularly adjacent recesses. The angular disposition of each recess about the circumference of the piston respectively corresponds to a radial distance between the port openings defined by the housing whereby achieving an enhanced opening of the ports during operation of said engine.

In one form, the pistons in each piston set are angularly oriented relative to the respective axial cylinder through the first and second ball joints of each piston rod assembly. Alternatively, the pistons in each piston set can be angularly oriented relative to the respective axial cylinder by a pin carried by the cylinder. In this later form, the pin engages and slides within an axially elongated exterior slot or recess defined by a skirt of each piston.

Preferably, the internal combustion engine of this invention disclosure further includes seal structure for minimizing the amount of lubricant passing between each piston and the respective axial cylinder associated therewith and minimizing the viscous losses and the gas leakage entering either of the end housings. In a preferred embodiment, such seal structure includes in operable combination a first ring, having a relatively low coefficient of friction and high wear resistance arranged within a groove defined by the cylinder, and a second elastomeric ring.

The lubrication system of the engine provides a suitable lubricant to mating and sliding surfaces defined by the engine whereby reducing the coefficient of friction while reducing the wear and providing a cooling effect between the sliding and moving parts. In one form, the main housing defines a series of annular cavities arranged in surrounding relation relative to each axial cylinder for directing various fluids through the engine and a series of annular exhaust cavities. The annular inlet cavities defined by the main housing are fluidically connected to a reservoir of compressed air passing from the mechanism for producing a forced stream of air. the seal structure at an intake side of the piston in each piston set. The engine can also include seal structure for minimizing gas from passing into the end housing supporting each swash plate mechanism.

In one form, two sets of annular inlet cavities defined by the main housing direct coolant about the axial cylinders, and wherein the two sets of annular inlet cavities for directing coolant about the axial cylinders are interconnected to each other. Preferably, one set of the annular inlet cavities for directing coolant about the axial cylinders is arranged adjacent to one side of the set of intake cavities and adjacent on the other side to a first side of the set of exhaust cavities and surrounds the inlet port through which fuel enters the engine. A second set of annular inlet cavities for directing coolant about the axial cylinders is disposed to a second side of the set exhaust cavities and at least partially surrounds the seal structure.

In one form, the series of annular exhaust cavities defined by the main housing are separated from each other, with each annular exhaust cavity being individually connected to the mechanism for producing a forced stream of air such that adjacent axial cylinders are connected to opposed sides of the mechanism for producing a forced stream of air. Preferably, a hollow sleeve is arranged in generally coaxial and surrounding relation relative to the shaft assembly for operably separating the annular cavities from each other.

Another aspect of this invention disclosure relates to an internal combustion engine including a main housing, an axially elongated shaft assembly arranged in the housing for rotation about a fixed longitudinal axis and with the shaft assembly having first and second longitudinally spaced angular cranks. The first and second swash plate mechanisms are arranged in axially spaced relation relative to each other. The first swash plate mechanism is operably associated with the first angular crank of the shaft assembly. The second swash plate mechanism is operably associated with the second angular crank of the shaft assembly.

Each swash plate mechanism has a rotating surface which rotates with the respective angular crank upon rotation of the shaft assembly, a set of two bevel gears with intermeshing teeth, a set of conical surface bearings, and a non-rotating disc. The rotating surface of each swash plate mechanism is in contact with the non-rotating disc through first and second rolling contact bearings. The non-rotating disc defines a plurality of spherical sockets arranged in a circular array for accepting and holding therewithin a first ball joint disposed toward a first end of a series of piston rod assemblies. The center of the circular array of sockets is disposed on the longitudinal axis and in a plane arranged generally parallel with the rotating surface of the respective swash plate mechanism.

In this family of embodiments, a cam follower assembly acts on a circular surface of the respective non-rotating disc. The cam follower assembly shares axial forces directed against the non-rotating disc with the first rolling contact bearing during engine operation. Of course, multiple cam follower assemblies, arranged in equidistant radially and angularly spaced relation, can be provided. Each cam follower assembly is arranged on a carrier mounted to the angular crank shaft of each swash plate mechanism.

Multiple axial cylinders are arranged in a circular array within the main housing. The cylinders are preferably equidistantly arranged from the longitudinal axis of the shaft assembly and between the first and second swash plate mechanisms. According to this aspect of the invention disclosure, a plurality of piston sets are provided for the engine. Each piston set includes first and second pistons arranged in each axial cylinder for reciprocal movements in opposed directions relative to each other. The first piston of each piston set is operably connected to the first swash plate mechanism by one of the series of piston rod assemblies. The second piston in each piston set is operably connected to the second swash plate mechanism by one of said series of piston rod assemblies. The pistons in each piston set define a spherical socket which accepts and holds therewithin a second ball joint disposed toward a second end of the series of piston rod assemblies. The pistons in each piston set also include a piston head forming part of a combustion chamber.

The shaft assembly operably maintains a fixed angular index between the first and second swash plate mechanisms. A pair of end housings are operably secured to the main housing. Each end housing supports a respective one of said swash plate mechanisms. A mechanism for producing a pressurized air stream is also arranged in operable combination with the housing. Moreover, there is provided a system operably associated with said forced air stream mechanism for injecting fuel through an inlet port defined by said housing and into each cylinder. A pump is provided for supplying lubricating and cooling fluid to a lubrication system.

In a preferred embodiment, the carrier for each cam follower assembly is adjustably secured to a respective crank shaft to minimize clearance between the cam follower assembly and a respective contact surface on the crank shaft. In one form, each cam follower assembly is adjustable through use of an eccentric. Each cam follower assembly preferably includes a bearing disposed a further radial distance from the longitudinal axis of the engine than is the center of the circular array of spherical sockets in non-rotating disc such that centrifugal forces developed during operation of the engine are carried by the bearing and with induced forces being carried by a thrust bearing.

According to another aspect of this invention disclosure there is provided an internal combustion engine including a main housing along with first and second swash plate mechanisms arranged in axially spaced relation relative to each other. An axially elongated shaft assembly is arranged in the housing for rotation about a fixed longitudinal axis. The shaft assembly includes first and second longitudinally spaced cranks.

In this embodiment, first and second swash plate mechanisms are arranged in axially spaced relation relative to each other. The first swash plate mechanism is operably associated with the first angular crank of the shaft assembly. The second swash plate mechanism is operably associated with the second angular crank of the shaft assembly. Each swash plate mechanism has a rotating surface operably attached to one of the cranks at an angle with respect to the longitudinal axis. This embodiment of the engine also includes a set of two bevel gears with intermeshing teeth and a set of conical surface bearings along with a non-rotating disc. In this first family of embodiments, the non-rotating disc is in contact with the rotating surface through a bearing arrangement including a glide thrust bearing arranged in operable combination with a journal bearing and a rolling contact thrust bearing. The non-rotating disc defines a plurality of spherical sockets for accepting and holding therewithin a first ball joint disposed toward a first end of a series of piston rod assemblies. A center of the circular array of sockets is disposed on the longitudinal axis and in a plane arranged generally parallel with the rotating surface of the respective swash plate mechanism.

Multiple axial cylinders are arranged in a circular array within the housing. Preferably, the cylinders are equidistantly arranged from the longitudinal axis between the first and second swash plate mechanisms. A plurality of piston sets are also provided. Each piston set includes first and second pistons arranged in each axial cylinder for reciprocal movements in opposed directions relative to each other. The first piston of each piston set is operably connected to the first swash plate mechanism by one in a series of piston rod assemblies. The second piston in each piston set is operably connected to the second swash plate mechanism by another in the series of piston rod assemblies. The piston in each piston set defines a spherical socket which accepts and holds therewithin a second ball joint disposed toward a second end of the series of piston rod assemblies. Each piston in each piston set includes a piston head which forms part of a combustion chamber.

The shaft assembly operably interconnects the angular cranks to each other while maintaining a fixed angular index between the first and second swash plate mechanisms. An end housing is operably secured to the main housing for supporting a respective one of the swash plate mechanisms. A mechanism for producing a pressurized stream of air is also arranged in operable combination with the housing. Moreover, there is provided a system operably associated with said forced air stream mechanism for injecting fuel through an inlet port defined by said housing and into each cylinder and a pump for supplying lubricating and cooling fluid to a lubrication system.

In one form, the glide thrust bearing has a circular configuration, in plan, and defines an inner diameter and an outer diameter. A line of action of the vector sum of all forces extending in the direction perpendicular to the glide thrust bearing is disposed angularly inside of the outer diameter of the glide thrust bearing. The internal combustion engine furthermore preferably includes a rotating seal arranged in surrounding relation relative to an outer diameter of the glide thrust bearing for inhibiting the flow of pressurized lubricant passing to the glide thrust bearing from escaping from between the rotating surface and the non-rotating disc. In one form, the rotating seal defines an orifice for controlling the flow of lubricant from between the rotating surface and the non-rotating disc.

Preferably, the glide thrust bearing is orientated with respect to the rotating surface and has a first and second major faces extending generally perpendicular to an axis of the respective angular crank. The first face of the glide thrust bearing is compartmentalized into high load and low load areas. The first major surface of the glide thrust bearing has first angularly spaced portions disposed axially closer to the non-rotating disc than are second angularly spaced portions on the first surface of the glide thrust bearing. The second angularly spaced portions defines a ramp which is angled in the direction of rotation of the rotating surface from a lower level to a higher level. The higher level on the second angularly spaced portions of the glide thrust bearing is disposed generally coplanar with the first angularly spaced portions so as to create a ramp effect on the lubricant, which creates, during operation of the engine, a hydrodynamic pressure of varying levels between the rotating surface and the non-rotating disc. Preferably, the ramp defined by the second angularly spaced portions on the glide thrust bearing is bounded by limits disposed toward inner and outer diameters of the glide thrust bearing. A surface on such limits is disposed generally coplanar with the first angularly spaced portions on the glide thrust bearing whereby entrapping lubricant therebetween and guiding lubricant along a length of the ramp on the glide thrust bearing toward and between the higher level on the first angularly spaced portions on the glide thrust bearing and the non-rotating disc. The first face of the glide thrust bearing has the second angularly spaced portions disposed closer to the non-rotating disc than the third angularly spaced portions angularly located between the first and second portions. The third angularly spaced portions contribute minimally to the viscous drag and permit a cooling flow of lubricant through the glide thrust bearing.

BRIEF DESCRIPTION OF THE DRAWINGS

FIG. 24 is an enlarged plan view of a glide thrust bearing used in operable combination with the alternative bearing arrangement illustrated in FIGS. 22 and 23;

FIG. 25 is a sectional view taken along line 25-25 of FIG. 23; and

FIG. 26 is an enlarged top plan view, in an unwrapped perspective, of the glide thrust bearing illustrated in FIG. 23.

DETAILED DESCRIPTION

Figure 1:
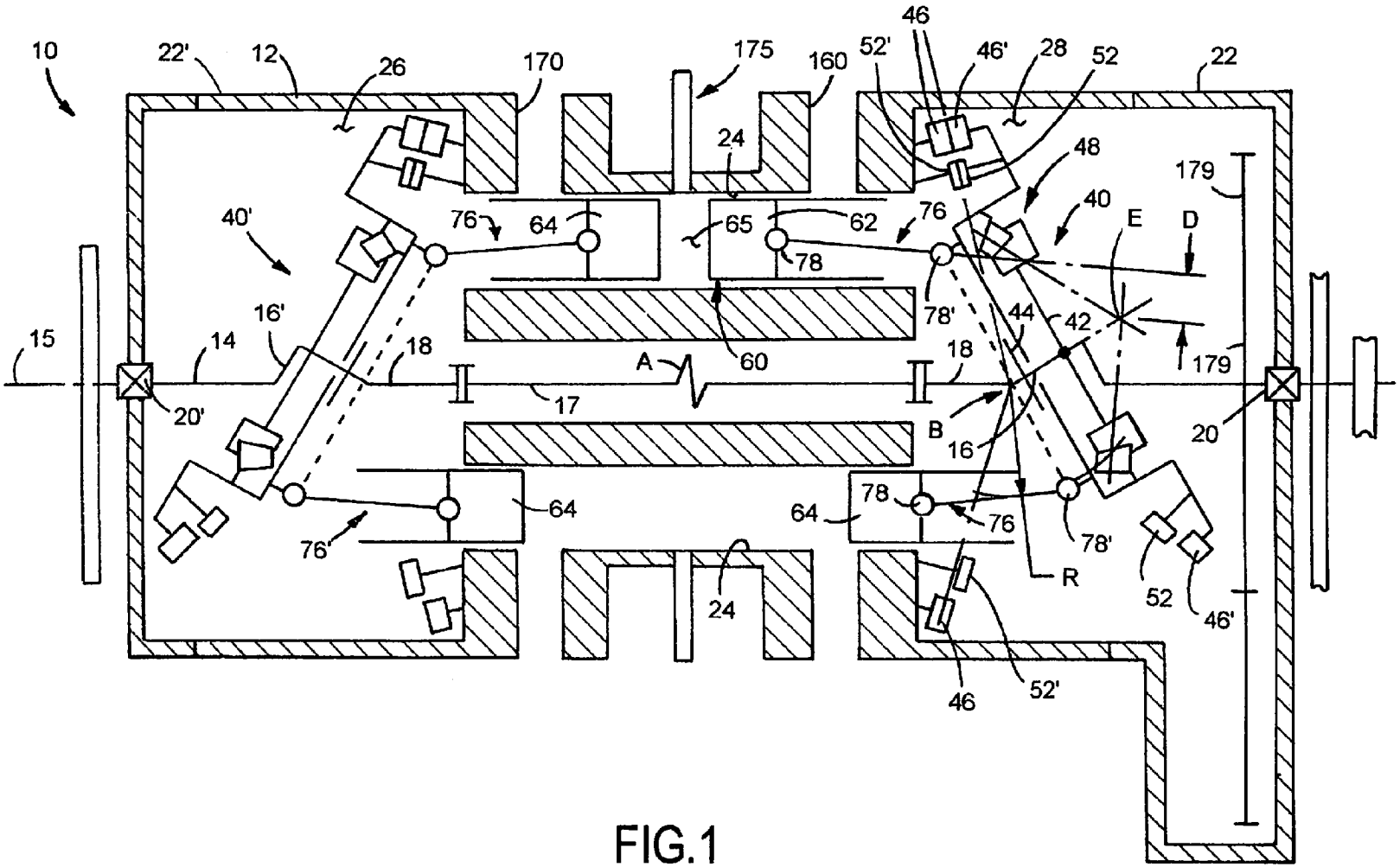
FIG. 1 is a schematic illustration of an internal combustion engine embodying principals and teachings of the present invention disclosure.

While this invention disclosure is susceptible of embodiment in multiple forms, there is shown in the drawings and will hereinafter be described preferred forms, with the understanding the present disclosure sets forth exemplifications of the disclosure which are not intended to the limit the disclosure to the specific embodiment illustrated and described.

Referring now to the drawings wherein like reference numerals indicate like parts throughout there several view, there is shown in FIG. 1 a two-cycle opposed piston internal combustion engine generally identified by reference numeral 10. Engine 10 includes a main housing 12 with an axially elongated rotatable shaft assembly 14 defining a fixed longitudinal axis 15 for the engine 10. Shaft assembly 14 includes two longitudinally spaced angular cranks 16, 16' which are each disposed at an acute angle relative to the longitudinal axis 15 of the engine 10. The opposed ends of shaft assembly 14 are journalled for rotation by suitable bearings 20, 20'. Each bearing 20, 20' is mounted in an end housing 22, 22' secured and suitably sealed to the main housing 12. As discussed in further detail below, shaft assembly 14 preferably includes a rotatable centershaft 17 with longitudinally spaced angular crank portions 18, 18' releasably connected to opposed ends of the centershaft 17.

Figure 2:
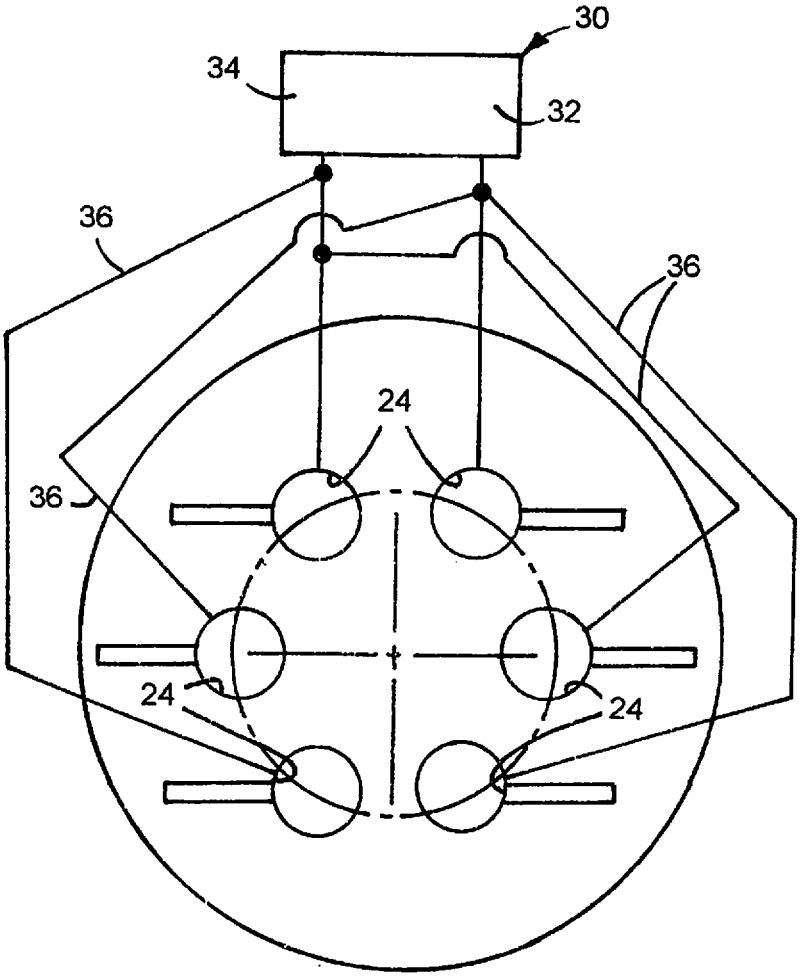
FIG. 2 is another schematic illustration of the internal combustion engine embodying principals and teachings of the present invention disclosure.

The main housing 12 of engine 10 defines multiple axial cylinders 24. The axial cylinders 24 are angularly and radially spaced from a longitudinal axis 15 of the engine 10. Although six cylinders are shown in FIG. 2 for exemplary purposes, it should be understood fewer or more cylinders can be embodied into the present design without detracting or departing from the novel spirit and scope of this invention disclosure. Engine 10 is operably divisible into an intake side 26 and an exhaust side 28.

In the embodiment schematically illustrated in FIG. 2, a source of pressurized air, generally indicated by reference numeral 30, is arranged in operable combination with engine 10. The source of pressurized air 30 can be in the form of a turbo-charger or air compressor. As schematically illustrated in FIG. 2, each cylinder 24 of engine 10 has an exhaust line 36 feeding directly into a first side 32 of the turbo-charger or a second side 34 of the turbo-charger 30. The exhaust lines 36 leading from cylinders 24 alternate in the sequence of firing to either the first or second side 32 or 34, respectively, of the turbo-charger 30. This alternating action minimizes the interference of the exhaust from one cylinder, which can be at the start of its exhaust cycle, in the gas exchange of the other cylinder, which can be in the middle of the exhaust cycle.

In the illustrated embodiment, as shown schematically in FIG. 1, engine 10 includes first and second axially spaced swash plate mechanisms 40 and 40' longitudinally disposed to opposite sides of the axial cylinders 24 defined by engine housing 12. Swash plate mechanism 40 is essentially symmetrical to swash plate mechanism 40'. In the illustrated embodiment, shaft assembly 14 operably interconnects the swash plate mechanisms 40 and 40' to each other. In the illustrated embodiment, swash plate mechanism 40 is disposed to an exhaust side 28 of engine 10 and swash plate mechanism 40' is disposed to an intake side 26 of engine 10.

Engine 10 further includes a plurality of piston sets 60. As will be discussed in detail below, each piston set 60 includes a first or exhaust piston 62 and a second or intake piston 64. The pistons 62, 64 are arranged in each axial cylinder 24 defined by housing 12 and define a combustion chamber 65 between juxtaposed ends. The pistons 62 and 64 are arranged for reciprocal movements in opposed directions relative to each other. A series of piston rod assemblies 76 serve to operably connect the first pistons 62 in each piston set to swash plate mechanism 40 and serve to operably and independently interconnect the intake pistons 64 in each piston set to swash plate mechanism 40'.

Figure 3:
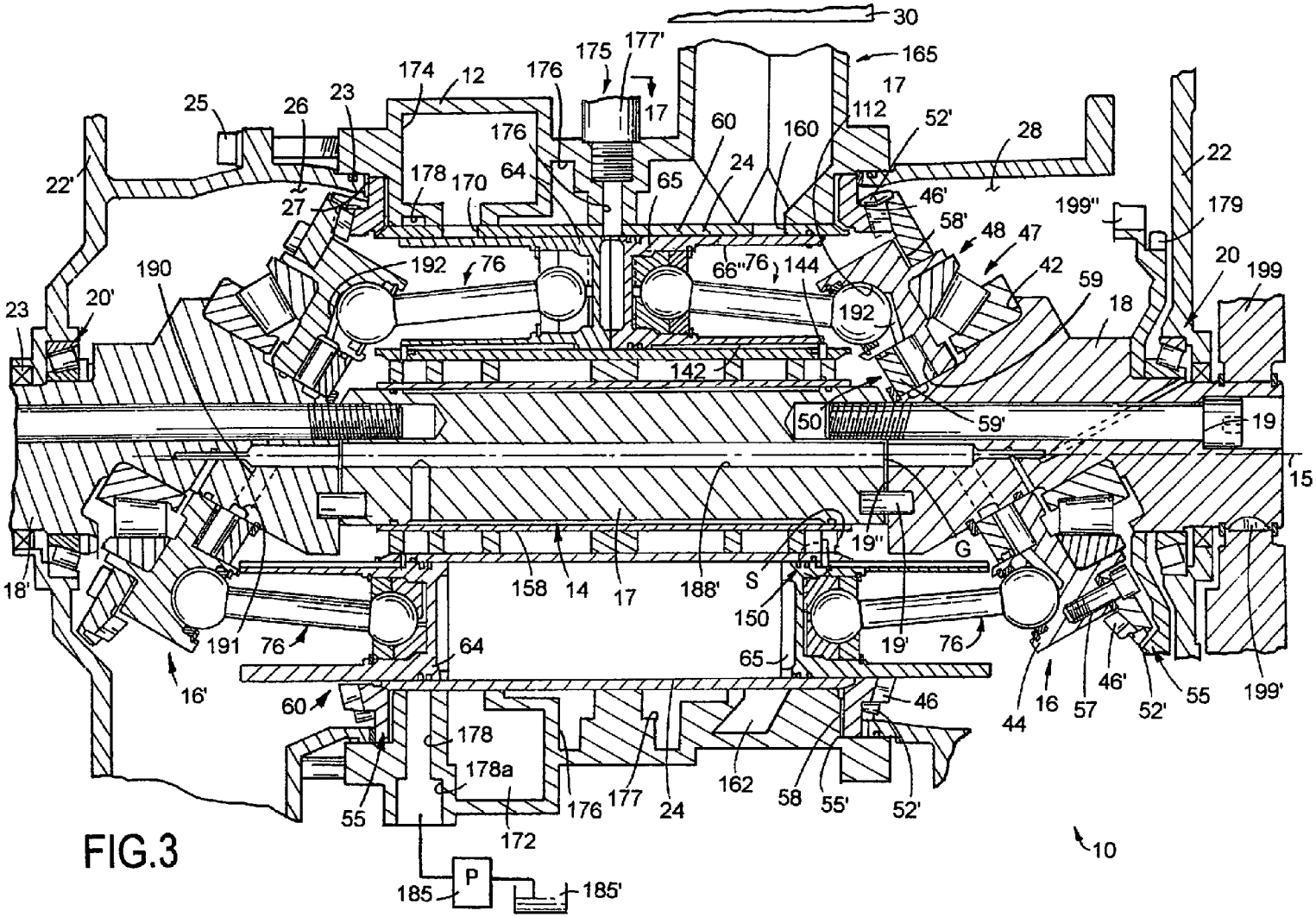
FIG. 3 is a fragmentary longitudinal sectional view of one form of the present invention disclosure.

In the embodiment shown by way of example in FIG. 3, the angular crank portions 18, 18' of shaft assembly 14 are releasably connected or conjoined to opposite ends of the centershaft 17 by suitable fasteners 19. In the illustrated embodiment, the fasteners 19 axially pass through the respective crank portion 18 to releasably secure the respective crank portion to an end of the centershaft 17. Prior to securing each crank portion 18 to an end of the centershaft 17, suitable dowels 19' and one or more shims 19" are installed between the respective angular crank portion 18 and the centershaft 17. The dowels 19' (with only one being shown) align the angular crank portions 18 with the centershaft 17 and determine the lag angle, preferably about 40 degrees, between the exhaust side and the intake side of the engine 10 (in operation of the engine, the dowels 19' also transmit torque). The largest portion of the torque, however, is transmitted through friction between the crankshaft 17 and angular cranks 18, 18'. In one form, the shims 19" disposed between the respective crank portion and the centershaft 17 allow the axial distance between the swash plate mechanisms 40, 40' and the juxtaposed ends of the first and second pistons 62 and 64, respectively, of each piston set 60 to be adjusted whereby modifying the volume of the combustion chamber between each pair of opposed pistons 62, 64.

In FIG. 1, the symbol of letter "A" represents an angular shift of the angular cranks 16, 16' relative to each other. As such, and during engine operation, there is an angular lag of about 40 degrees between the exhaust side 26 of engine 10 with respect to the T.D.C. of engine 10. Thus, the exhaust piston 62 in each piston set reaches T.D.C. at about 40 degrees rotation of the shaft assembly 14 before the intake piston 62. It should be appreciated by those skilled in the art, the angular lag of about 40 degrees is used only as an example and other angular offsets would equally suffice without detracting or departing from the spirit and scope of this invention disclosure.

In the illustrated embodiment of engine 10, the swash plate mechanisms 40, 40' are substantially identical in construction and, thus, only swash plate mechanism 40 will be described in detail. As shown in FIGS. 1 and 3, each swash plate mechanism has a rotating surface 42 which rotates with the respective angular crank upon rotation of shaft assembly 14 and is disposed at an angle with respect to the longitudinal axis 15 of engine 10. As shown in FIGS. 1 and 3, each swash plate mechanism also includes a non-rotating disc 44 operably secured to the engine housing 12.

In the illustrated embodiment of engine 10 shown by way of example in FIGS. 1 and 3, each swash plate mechanism further includes a set of two bevel gears 46 and 46' for keeping the respective non-rotating disc 44 of the respective swash plate mechanism from rotating. Each bevel gear 46, 46' preferably has the same number of teeth. In the illustrated embodiment, bevel gear 46' is secured to the non-rotating disc 44 of a respective swash plate mechanism. In the illustrated embodiment, bevel gear 46 is concentrically arranged relative to an axis of relative rotation between the rotating surface 42 and the non-rotating disc 44 of the respective swash plate mechanism. Bevel gear 46 is operably secured to the engine housing 12 and, preferably, is concentrically arranged relative to the longitudinal axis 15 of engine 10. Preferably, and as shown schematically in FIG. 1, the bevel gears 46, 46' of each swash plate mechanism are designed and disposed such that an apex of the two intermeshing bevel gears 46, 46' is located on the longitudinal axis 15 of the engine 10 at location "B". As shown in FIGS. 1 and 3, a diameter of the bevel gears 46, 46' operably surrounds the respective swash plate mechanism A bearing arrangement 47 maintains the rotating surface 42 and non-rotating disc 44 of each swash plate mechanism in contact. In the illustrated embodiment of engine 10 shown by way of example in FIG. 3, the bearing arrangement includes first and second rolling contact bearings 48 and 50. In the illustrated embodiment, bearing 48 is in the form of a tapered roller or ball bearing. In the illustrated embodiment, the rolling contact bearing 50 is in the form of a thrust bearing.

Returning to the schematic showing FIG. 1, bearing 48 is designed and disposed such that the point of intersection between the longitudinal axis 15 of engine 10 with an axis of relative rotation of the bearing 50 is likewise shown at location "B".

In the illustrated embodiment of engine 10 shown by way of example in FIGS. 1 and 3, each swash plate mechanism further includes a set of conical surface bearings 52 and 52'. The conical surface bearing 52 is operably attached to the non-rotating disc 44 of the respective swash plate mechanism. Bearing 52 is concentrically arranged relative to the axis of relative rotation between the rotating surface 42 and non-rotating discs 44 of the respective swash plate mechanism. Conical surface bearing 52' is operably attached to the engine housing 12 and is concentrically arranged relative to the longitudinal axis 15 of the shaft assembly 60. Preferably, a diameter of the conical surface bearings 52, 52' encircles the respective swash plate mechanism whereby causing a moment arm about an effective center of the bearings 52, 52' so as to produce a force which counteracts the imbalance of moments generated by accelerating forces at higher than normal engine operating speeds.

As schematically represented in FIG. 1, the conical surface bearings 52 and 52' of each swash plate mechanism are disposed and designed such that a line of contact between the two bearings 52, 52' intersects with the longitudinal axis 15 of engine 10 at point "B". That is, in a preferred embodiment, and as schematically represented in FIG. 1, the conical surface bearings 52 and 52' of each swash plate mechanism are disposed and designed such that a line of contact between the two bearings 52, 52' passes through an intersection of the longitudinal axis 15 of rotation of shaft assembly 14 and the axis of relative rotation between the rotating surface 42 and non-rotating discs 44 of a respective swash plate mechanism.

In a preferred embodiment of this invention disclosure shown in FIG. 3, the bevel gear 46' and conical surface bearing 52 are connected as a bevel gear-conical surface bearing assembly 55 to the non-rotating disc 44 as through an indexing dowel or pin (not shown) and a suitable fastener 57. Moreover, in a preferred embodiment of this invention disclosure shown in FIG. 3, bevel gear 46' and conical surface bearing 52' are conjointly secured to housing 12 as an assembly 55' as through an indexing dowel or pin (not shown) and a suitable fastener (not shown). Notably, however, and for purposes discussed below, one or more shims 58 are secured between housing 12 and bevel gear-conical surface bearing assembly 55'.

Figure 4:
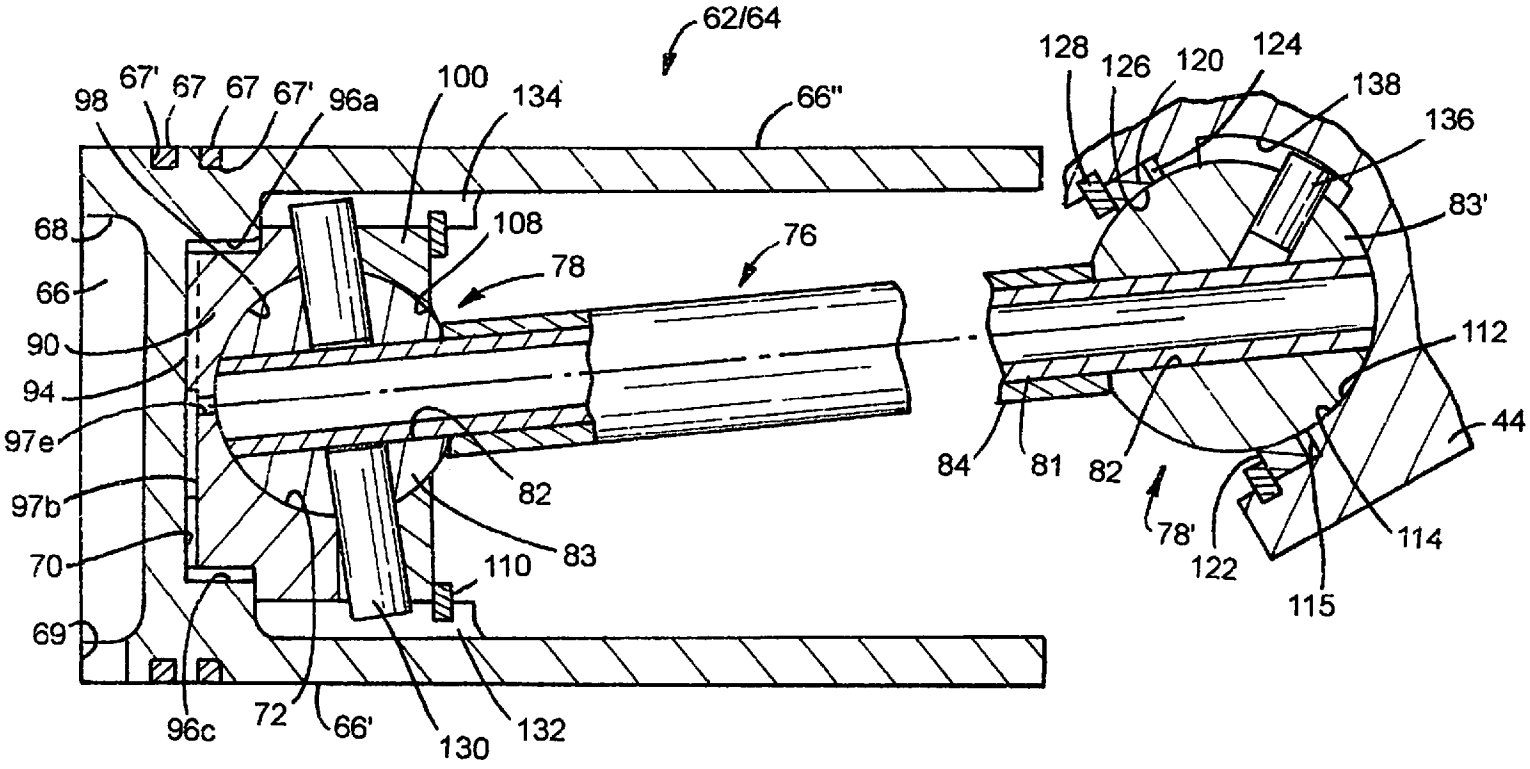
FIG. 4 is a longitudinal sectional view of a piston and piston rod assembly forming part of the present invention disclosure.

To reduce costs and for other advantageous purposes, the pistons 62 and 64 of each piston set 60 are substantially identical relative to each other. Accordingly, only one piston will be described in detail. Turning to FIG. 4, each piston includes a piston head 66 including piston rings 67 arranged within annular grooves 67' on each piston. Rings 67 slidably seal against the respective axial cylinder defined by the housing 12 during operation of the engine 10.

Figure 5:
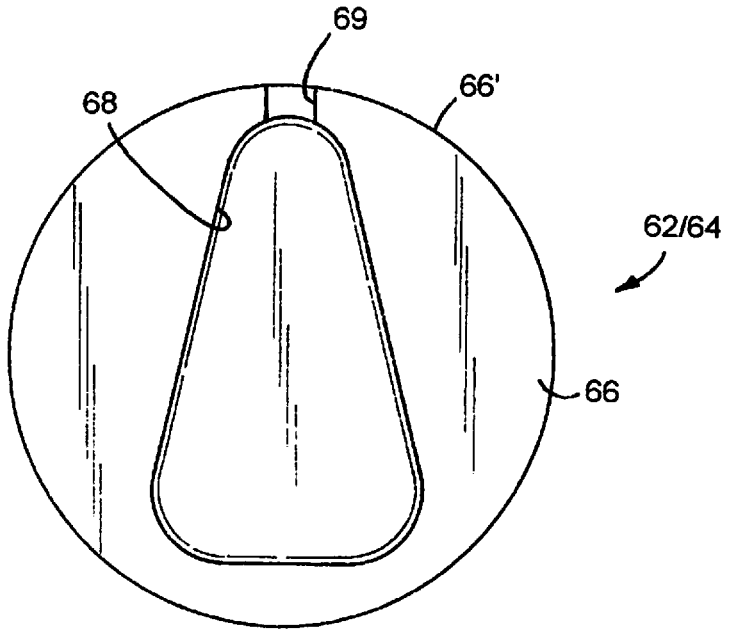
FIG. 5 is a left end view of the piston illustrated in FIG. 4.

As shown in FIGS. 4 and 5, the piston head 66 of each piston also preferably defines an open-ended combustion chamber 68 having an optimized volume and opening to one side or end of the piston head 66. An inlet port 69 (FIGS. 4 and 5) preferably extends from chamber 68 and opens to a cylindrical side 66' of the respective piston. At the smallest compression volume, the two opposing pistons 62, 64 in each piston set 60 are a minimum distance (established by the manufacturing tolerances) apart. The intake port and the exhaust port in the cylinder are in the form of slots with rounded ends. The rounded ends are preferable to allow the piston rings 67 to slide thereacross without catching or otherwise seizing on the edge of the slot. The slots are arranged such that the inlet opening in the piston is indexed in the space between two angularly adjacent slots to prevent premature opening of the intake or exhaust ports, respectively.

FIG. 3 schematically shows a cross-section of one embodiment of the invention disclosure with the illustrated piston sets being shown 180 degrees apart with respect to the axis of rotation of the engine. It should be appreciated, FIG. 3 is presented with an intentional inconsistency which shows on the two pistons on one side of the engine 10 but on opposed sides of the longitudinal axis 15 disposed at T.D.C and B.D.C, respectively, yet it shows a combustion chamber at minimum volume. Whereas, this minimum volume actually occurs at one half of the advance angle of the exhaust side with respect to the T.D.C. of the engine. Thus, if the advance angle is, for example, 40 degrees, then the minimum volume occurs at 20 degrees from T.D.C. This minor inconsistency is necessary to show the contact line of the two conical surface bearings 52, 52' in addition to the engagement of the bevel gears 46, 46' both of which occur at T.D.C.

Figure 6:
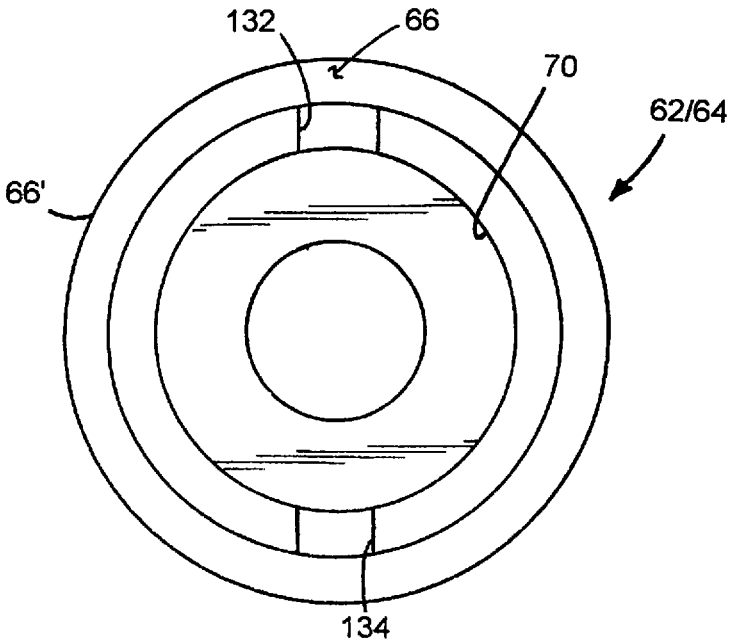
FIG. 6 is a right end view of the piston illustrated in FIG. 4.

Axially extending from the piston head 66, each cylinder includes an axially elongated cylindrical skirt 66". As shown in FIGS. 4 and 6, and opposite from chamber 68, each piston furthermore defines a blind socket 70. In the illustrated embodiment, each piston further defines a spherical socket 72 for accepting and holding a ball joint 78 disposed toward a first end of each piston rod assembly 76 (FIG. 4).

Figure 7:
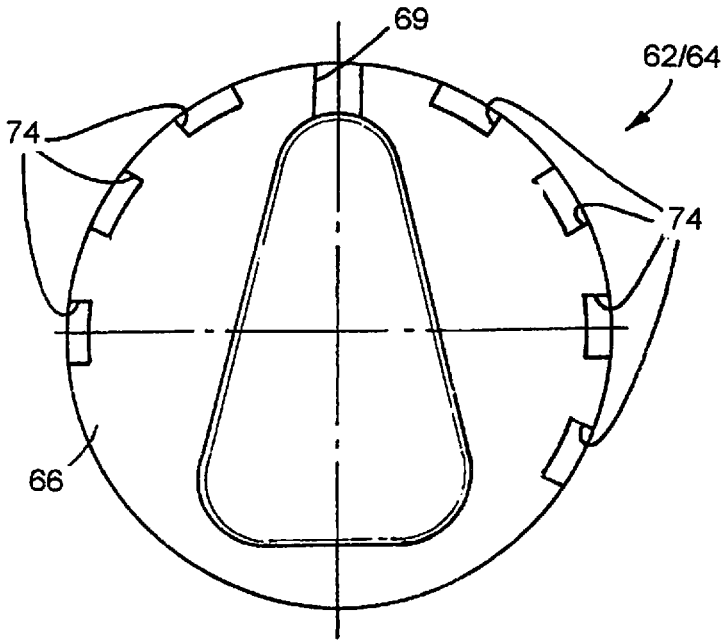
FIG. 7 is a left end view of an alternative piston design.
Figure 8:
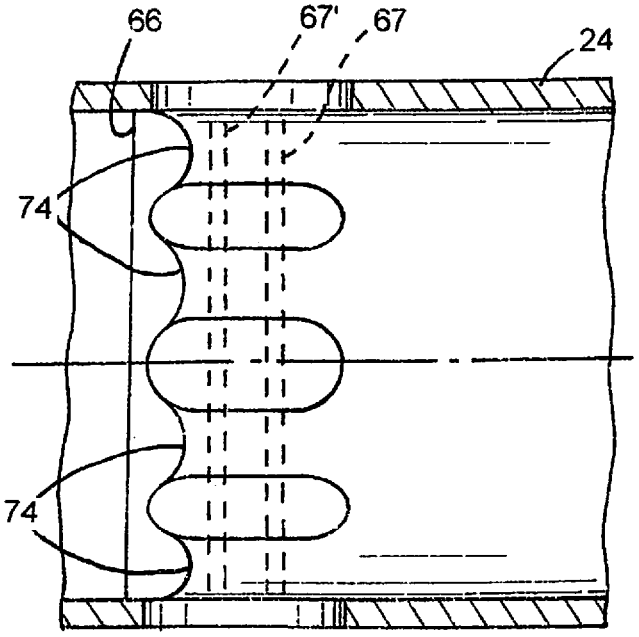
FIG. 8 is a longitudinal sectional view of an axial cylinder and a fragmentary view of a piston embodying principals and teachings of this invention disclosure arranged in the axial cylinder.

Alternatively, and as shown in FIG. 7, each piston head 66 can be designed with one or more recesses 74 formed in and about a portion of the circumference of each piston. Each recess 74 axially extends from a location forward of the piston rings 67, 67' to the end of the piston head. As shown in FIG. 8, the angular disposition of the recesses 74 corresponds to areas between two openings in the respective cylinder 24 so as to prevent premature opening of the inlet port defined by housing 12 during operation of said engine.

The symbol or letter "D" in FIG. 1 indicates the moment arm between the line of action of the piston rod assembly 76 and the effective center, indicated by letter or symbol "E" in FIG. 1, of the rolling contact bearing 48. The length of this moment arm is minimized by locating the rolling contact bearing 48 at a greater distance from the longitudinal axis 15 than the center of the circular array of the spherical sockets in the non-rotating disc 44.

At lower than operating speed, the gas pressure forces dominate and the resulting moment imbalance is carried by rolling contact bearing 50 of the bearing arrangement 47 disposed between thrust surfaces 59 and 59'. As shown in FIG. 3, thrust surface 59' extends parallel to the rotating surface 42 and is operably associated with the angular crank 16 of the each swash plate mechanism. Thrust surface 59 is operably associated, and in the illustrated embodiment, is attached to the non-rotating disc 44. At speeds higher than normal operating speed, the acceleration forces become dominant and the resulting moment imbalance is substantially carried by conical surface bearings 52, 52'.

As will be appreciated, acceleration forces increase rapidly at the square of the speed. Thus, the conical surface bearings 52, 52' offer a large moment arm which is advantageously used to absorb these larger forces. Applicant has learned the capacity and position of the rolling contact bearing 50 of bearing assembly 47 would be insufficient to carry these higher forces, if the conical bearings 52, 52' were absent from the engine design. As such, the conical surface bearings 52, 52' advantageously and effectively extend the speed limit of the engine significantly.

Figure 9:
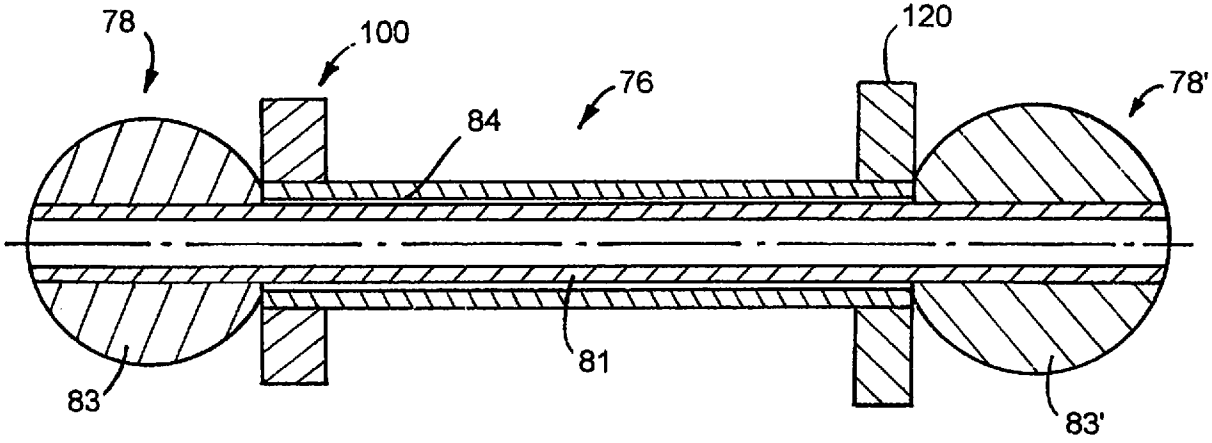
FIG. 9 is a longitudinal sectional view of one form of piston rod assembly embodying principals and teachings of this invention disclosure.

As shown in FIGS. 4 and 9, each piston rod assembly 76 used to operably interconnect the pistons 62, 64 (FIG. 3) to the respective swash mechanism includes the ball joints 78 disposed toward the first end of the piston rod assembly 76 and second ball joint 78' disposed toward a second end of each piston rod assembly 76. In FIG. 4, ball joint 78 operably connects the piston rod assembly 76 to one of the pistons in each piston set while ball joint 78' operably connects the piston rod assembly 76 to the non-rotating disc 44 of the respective swash plate mechanism.

Returning to FIG. 1, the path of the ball joint 78', whereat piston rod assembly 76 is operably connected to the non-rotating disc 54 of the respective swash plate mechanism, moves in an arc having a radius "R" the center of which is disposed at point "B". The arc "R" essentially forms a plane in which the ball joint 78' moves. Furthermore, in a preferred embodiment shown in FIG. 1, those ball joints 78' of the piston rod assemblies 76 which are disposed 180 degrees apart from each other lie on a straight line which intersects with the longitudinal axis 15 of the engine 10 at point "B".

In the form shown in FIGS. 4 and 9, the ball joints 78, 78' at opposed ends of each piston rod assembly 76 are joined to each other by an elongated tube 81 which is press-fit into appropriately sized holes or openings 82 defined by a pair of longitudinally spaced spherical elements 83, 83'. A rod 84 is fit about and along the length of tube 81 whereby maintaining the longitudinal spacing between the spaced spherical elements 83, 83'.

In the embodiment illustrated by way of example in FIGS. 4 and 9, the diameter of the spaced spherical elements 83, 83' are different from each other. The disclosed construction of the piston rod assembly 76 advantageously permits the spherical elements 83, 83' to be individually, accurately and economically produced. Moreover, the preferred construction yields several other advantages. First, the elements 83, 83' can be very accurately hardened. Second, the elements 83, 83' can be produced at relatively low cost. Third, the elements 83, 83' can be machined using laser technology thus rendering high control over tolerance variations. Of course, other piston rod assembly designs would equally suffice without detracting or departing from either the spirit or broad scope of this invention disclosure.

Figure 10:
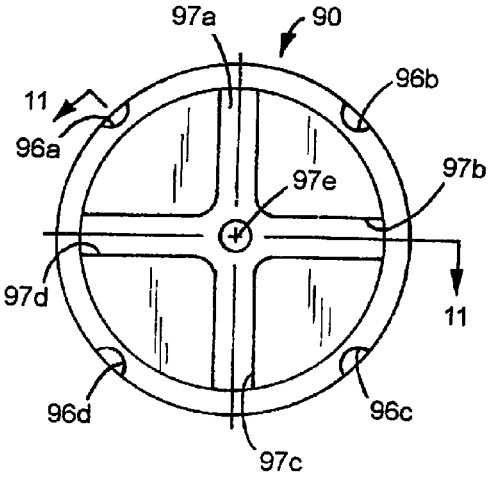
FIG. 10 is an end view of one form of spacer used in operable combination with the piston illustrated in FIGS. 4 and 7.

Returning to FIG. 4, the spherical socket 72 in the piston head 66 is preferably defined by a spacer 90 and retainer 100. As shown in FIG. 10, spacer 90 has a generally cylindrical configuration along with opposed and generally parallel and planar faces 92 and 94. Suffice it to say, and as shown in FIG. 4, spacer 90 is configured to slidably fit within the blind socket 70 defined by the piston head 66. Spacer 90 serves two functions. First, spacer 90 absorbs and transmits heavy loads from the respective piston. Spacer 90 can be manufactured from any of s series of materials selected for this purpose and to optimize this function. Second, spacer 90 preferably serves as a distribution agent for the lubricant to cool the piston head 66.

Figure 11:
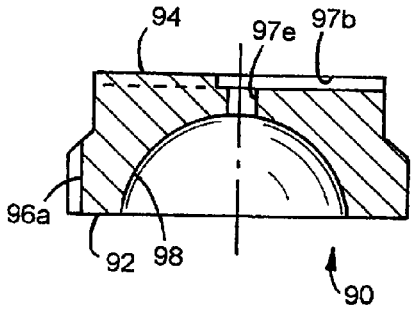
FIG. 11 is a sectional view taken along line 11-11 of FIG. 10.

In this regard, and as shown in FIG. 10, spacer 90 preferably defines a series of axially elongated and open-ended grooves 96*a*, 96*b*, 96*c* and 96*d* equidistantly arranged about a circumferential edge thereof. As shown in FIG. 11, spacer 90 defines a semi-spherically shaped and generally centrally disposed recess 98 opening to face 92. Recess 98 is formed with a radius which is generally equal to the radius of the spherical element 83. Moreover, spacer 90 defines a series of lubricant passages 97*a*, 97*b*, 97*c* and 97*d* which extend outwardly from a generally centralized opening 97*e* and open to a circumferential edge of spacer 90. Notably, and besides opening to each of the lubricant passages 97*a*, 97*b*, 97*c* and 97*d*, opening 97*e* also opens to recess 98.

Figure 12:
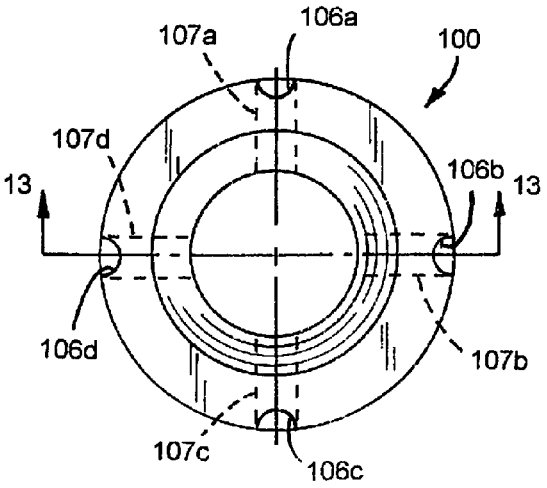
FIG. 12 is an end view of one form of retainer which is used in operable combination with the piston illustrated in FIGS. 4 and 7.
Figure 13:
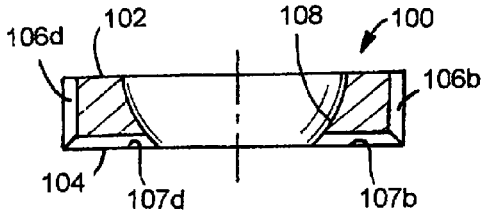
FIG. 13 is a sectional view taken along line 13-13 of FIG. 12.

As shown in FIG. 12, retainer 100 has a generally cylindrical configuration generally equal to the generally cylindrical configuration of spacer 90. Turning to FIG. 13, the cylindrical configuration of retainer 100 preferably extends between opposed and generally parallel and planar faces 102 and 104 and preferably defines a series of axially elongated and open-ended grooves 106*a*, 106*b*, 106*c* and 106*d* equidistantly arranged about a circumferential edge thereof. Moreover, and as shown in FIG. 13, face 104 of retainer 100 preferably defines a series of lubricant passages 107*a*, 107*b*, 107*c* and 107*d* which radially extend outwardly from a center of retainer 100 and, when spacer 90 and retainer 100 are arranged in operable combination relative to each other, generally align with the lubricant passages 97*a*, 97*b*, 97*c* and 97*d* defined by spacer 90.

As best shown in FIG. 4, and after spacer 90 is slidably inserted into the blind socket 70 defined by piston head 66, retainer 100 is thereafter slidably inserted into operable combination therewith. Moreover, and as shown in FIG. 13, retainer 100 defines a semi-spherically shaped and generally centrally disposed recess 108 opening to both sides or faces 102, 104 of retainer 100. Recess 108 is formed with a radius which is generally equal to the radius of the spherical element 83. After the spacer 90 and retainer 100 are arranged in operable combination with each other within the piston head 66, the recesses 98 and 108 on spacer 90 and retainer 100, respectively, combine with each other to slidably envelope and hold the spherical element 83 of ball joint 78 therebetween. A releasable retainer ring 110 (FIG. 4) serves to endwise entrap the spacer 90 and retainer 100 between the ring 110 and the end of the blind socket 70 in the piston head 66.

Returning to FIG. 3, the non-rotating disc 44 of each swash plate mechanism defines a plurality of sockets 112 arranged in a circular array relative to each other. As schematically represented in FIG. 1, a center of the circular array of sockets 112 defined by the non-rotating disc 44 is located on the longitudinal axis 15 of the engine 10 preferably at point "B". As schematically represented in FIG. 1, a plane of the circular array of sockets 112 defined by the non-rotating disc 44 extends parallel to the rotating surface of the respective swash plate mechanism. The sockets 112 in the non-rotating disc 44 are configured to accept and hold therewithin the ball joint 78' disposed toward the second end of the respective piston rod assembly 80.

In the embodiment illustrated by way of example in FIG. 4, each socket 112 of the non-rotating disc 44 of each swash plate mechanism includes a semi-spherically shaped recess 114 opening to that side of the disc 44 facing the respective piston. Recess 114 is formed with a radius which is generally equal to the radius of the spherical element 83' of the ball joint 78' on the piston rod assembly 76. Each recess 114 opens to a radial shoulder 115 defined by the non-rotating disc 44 of the respective swash plate mechanism.

As shown by way of example in FIG. 4, each socket 112 in the non-rotating disc 44 is further defined by a retainer 120 arranged in operable combination with the recess 114 defined by the respective non-rotating disc. Turning to the embodiment shown in FIG. 4, retainer 120 has generally parallel and planar faces 122 and 124. As shown in FIGS. 8 and 9, and like retainer 100 described above, retainer 120 furthermore defines a semi-spherically shaped and generally centrally disposed recess 126 opening to one side of retainer 120. Recess 126 is formed with a radius which is generally equal to the radius of the spherical element 83' (FIG. 4) of the piston rod assembly 76. When retainer 120 is assembled to the non-rotating disc 44 of the respective swash plate mechanism, the spherical surface 126 of the retainer 120 contacts the surface of the spherical element 83' to slidably envelope and hold the spherical element 83' of the piston rod assembly 76 therebetween. A releasable retainer ring 128 serves to endwise entrap retainer 120 against the non-rotating disc 54 of the respective swash plate mechanism.

To produce a snug fit between the ball joints 78, 78' at opposed ends of the piston rod assembly 76 relative to the piston head 66 and non-rotating disc 44, respectively, of each swash plate mechanism, the retaining rings 110, 128 are preferably selected from a group of retaining rings with a variety of thicknesses or widths. That is, the retaining rings 110 and 128 used in operable combination with the ball joints 78, 78' at the ends of the piston rod assembly 76 can have varying thicknesses between the opposed planar surfaces or faces thereof to fill or otherwise accommodate tolerance variations associated with each ball joint.

The natural tendency of the pistons 62, 64 is to move in a straight line without rotation in the cylinder 24 due to friction caused by the piston rings 67 against the cylinder 24 and against the face of the ring groove 67' in the piston 62, 64. This friction resists rotation of the piston 62, 64 with respect to the cylinder 24. In addition, the rotational inertia of the piston 62, 64 resists this motion.

Applicant recognizes, however, there can be small moments created by the friction in the ball joints 78, 78' of each piston rod assembly 76 which can have a tendency to rotate the piston 62, 64 a small increment. Typically, these moments are too small to overcome the friction caused by the piston rings 67, yet, the pistons 62, 64 still may drift slowly out of its initial orientation as it cycles back and forth.

Accordingly, and in one form of the invention disclosure, the ball joints 78, 78' of each piston rod assembly 76 are preferably designed to angularly orientate the respective piston relative to the respective axial cylinder 24. As shown in FIG. 4, the ball joint 78 at the end of the piston rod assembly 76 connected to the piston includes a pin 130 extending radially outward from opposed sides of the spherical element 83. Opposed ends of the pin 130 are slidably engaged in elongated grooves 132, 134 (FIGS. 4 and 6) defined in the piston head 66 to correct any drifting from the normal pass of the piston.

Moreover, the ball joint 78' at the opposite end of the piston rod assembly 76 includes a pin 136 extending radially outward from at least one side of the spherical element 83'. A free end the pin 136 is slidably accommodated in a groove 138 opening to recess 114 in the non-rotating disc 44 and corrects any drifting from the normal pass of the piston. There is relative angular motion between the pins 130 and 136 in the direction of rotation. (one pin advances or lags with respect to the other depending on the angle of rotation of the engine). This movement is at a maximum at about 45 degrees from TDC and BDC of the piston.

This relative angular motion is allowed by the width of the respective grooves 132, 134 and 138, as long as the piston remains in its neutral pass. If the piston drifts out of the pass in one direction, within half of a revolution of the engine, the pins 130, 136 will contact the limits defined by the respective grooves 132, 134 and 136, respectively, defined by the piston head 66 and non-rotating disc 44 on one side and push the piston back into its neutral pass.

If the piston drifts out of its neutral pass in the other direction, within half of a revolution of the engine, the pins 130, 136 will contact the other side of the respective grooves 132, 134 and 136 and urge the piston back towards its neutral pass. Thus, even though the piston can drift from its straight line pass in a certain range of angles of rotation of the engine, the piston will be urged back to its pass at least once in every revolution of the engine.

Alternative structure for resisting each piston from rotationally drifting from its initial orientation as it cycles and/or reciprocates back and forth is shown by way of example in FIG. 3. In the embodiment shown by way of example in FIG. 3, an open sided axial groove 142 is defined by the outer cylindrical surface of piston skirt 66" and opens to the cylinder 24. As shown in FIG. 3, a pin 144, preferably carried by the cylinder 24, extends radially toward the center of the cylinder 24 and extends into the open-sided axial groove 142 in the piston skirt 66" whereby keeping the respective piston from drifting or rotating during engine operation.

As shown in FIG. 3, the engine 10 of the present invention disclosure furthermore preferably includes seal structure 150 disposed toward an outer edge of each cylinder 24 to inhibit exhaust and intake gases from entering the adjacent end housing 22. In one form, the seal structure 150 also advantageously acts as a "wiper" to minimize the lubricant between the cylinders 24 and the respective pistons 62, 64. When the skirt 66" of the axial cylinder 24 is designed with an axial groove 142 to accommodate pin 144 for resisting each piston from rotationally drifting from its initial orientation, as described above, the seal structure 150 at each end of cylinder 24 will only have partial sealing effect to keep gas from leaking into the respective end housing 22. As mentioned above, however, and in a preferred form, seal structure 150 also serves to advantageously "wipe" lubricant from the piston skirt 66" whereby maintaining the lubricant film between the piston and the cylinder to a minimum.

Figure 14:
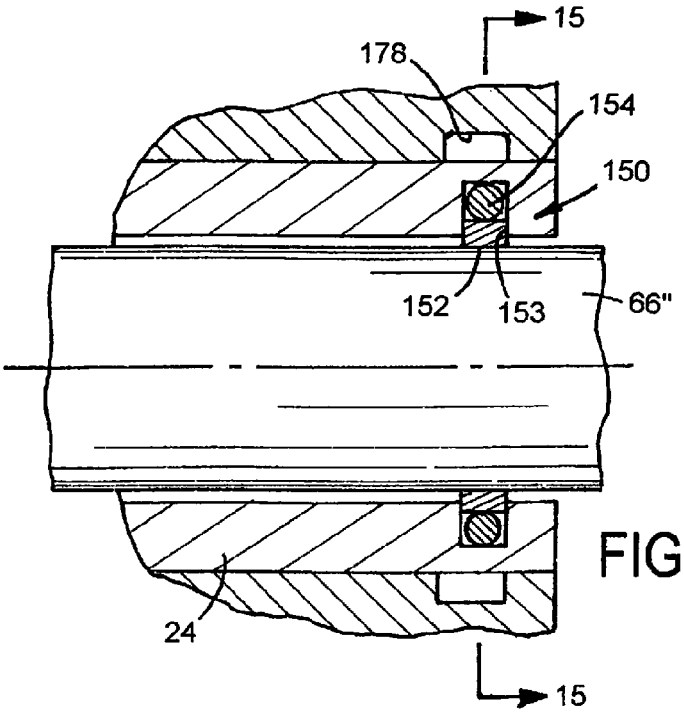
FIG. 14 is an enlarged sectional view of the area encircled in dash lines in FIG. 3.
Figure 15:
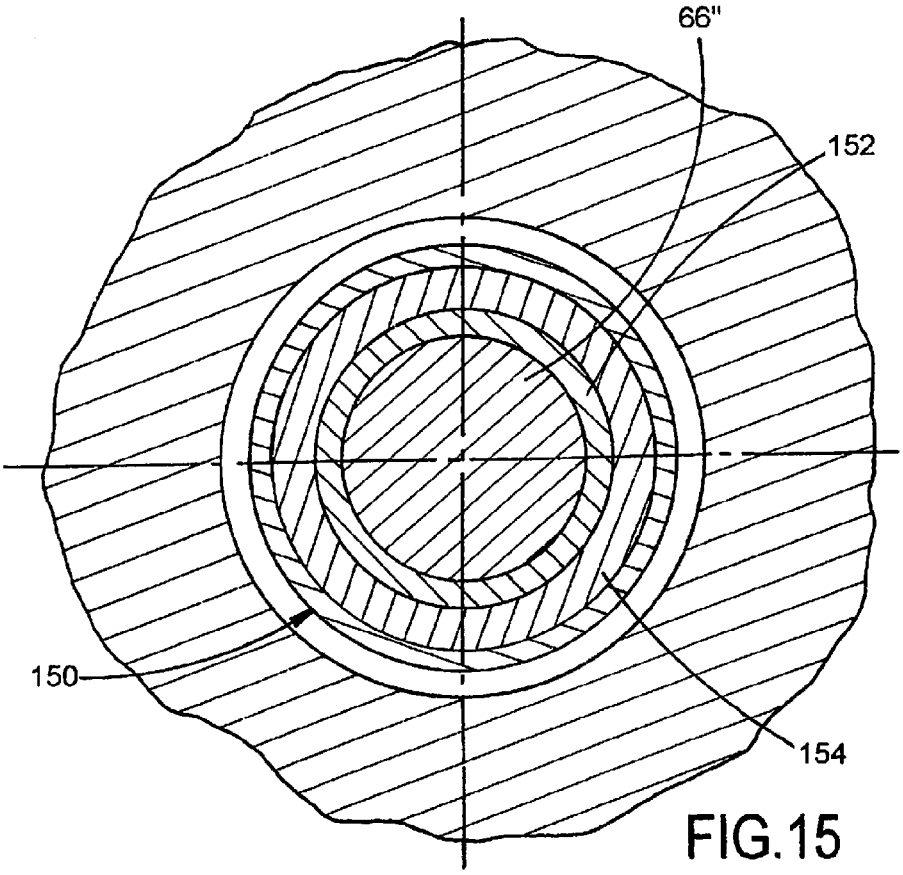
FIG. 15 is a sectional view taken along line 15-15 of FIG. 14.

In the form illustrated by way of example in FIGS. 14 and 15, seal structure 150 includes, in operable combination with each other, a first ring 152 and second ring 154. Ring 152 is formed from a suitable material having a relatively low coefficient of friction and high wear and heat resistance. Ring 152 is preferably a one-piece ring which is arranged within a groove 153 defined by the axial cylinder 22 and is in sliding contact with the shaft assembly 14. In a preferred embodiment, the ring 152 is arranged in sliding contact with the skirt portion 66" of the respective piston. Ring 154 is likewise arranged preferably arranged within groove 153 in surrounding relation relative to ring 152. Ring 154 is preferably formed from an elastomeric material so as to apply a radially inward force or load on the ring 132 whereby equally squeezing ring 132 about the outer circumference of shaft assembly 132.

Figure 16:
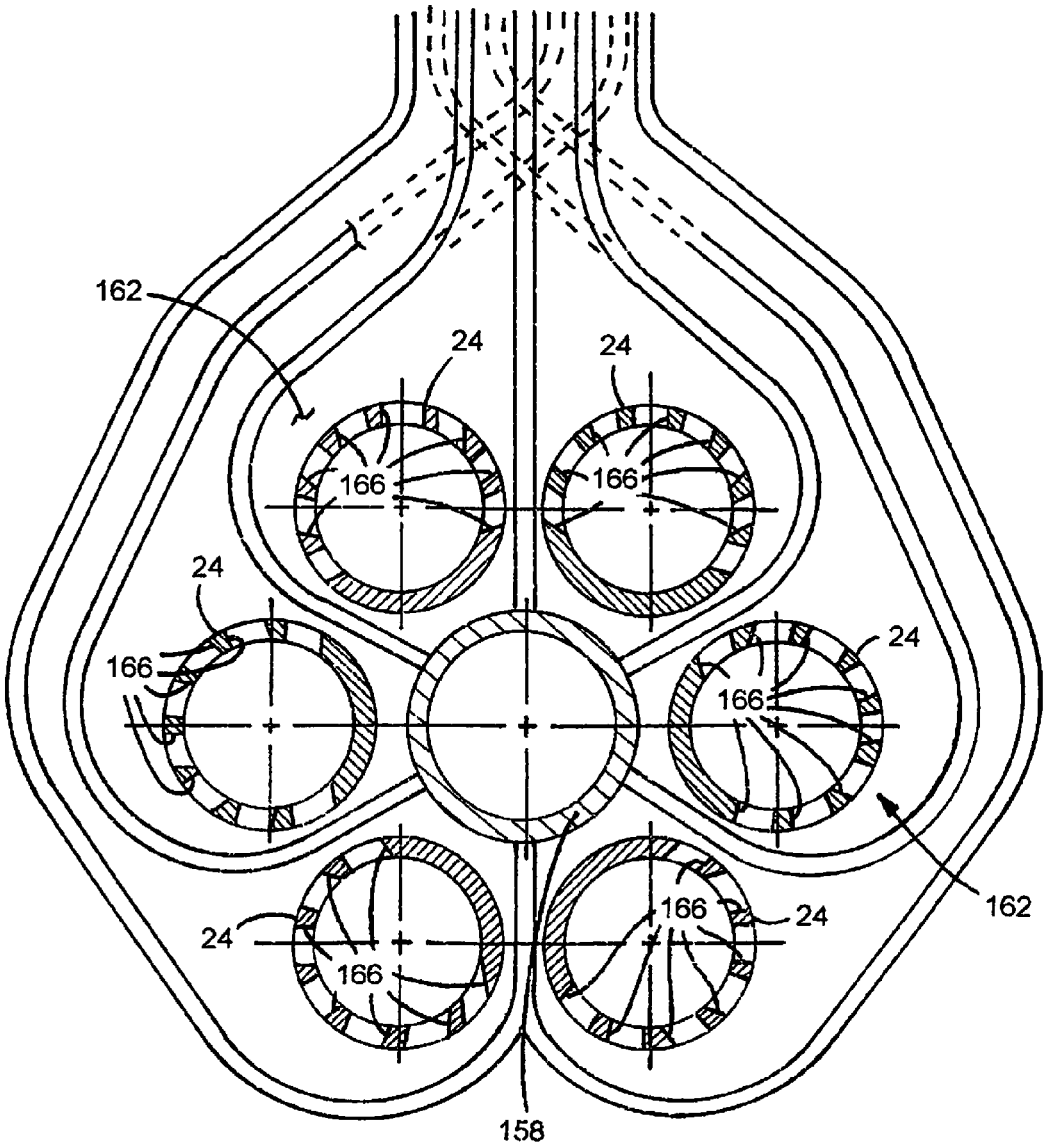
FIG. 16 is a sectional view of cored passages in a housing of the engine.

Returning to that embodiment of the invention disclosure illustrated by way of example in FIG. 3, each cylinder 24 defines exhaust or outlet ports 160 and axially spaced inlet or intake ports 170 (with only one of each being shown in FIG. 3). As shown in FIGS. 3 and 16, the exhaust ports 160 of each cylinder 24 are operably associated and fluidically connect with an annular exhaust cavity 162 defined by the main housing 12 of engine 10. Similarly, and as shown in FIGS. 3 and 16, the inlet ports 170 of each cylinder 24 are operably associated and fluidically connect with an annular inlet cavity 172 defined by the main engine housing 12.

Engine 10 further includes a system 175 operably associated with the mechanism 30 for injecting fuel through the inlet openings 170 defined by the housing 12 and into each cylinder 24. In the embodiment illustrated by way of example in FIG. 3, system 175 includes a conventional fuel injector 177', carried by housing 12, for directing fuel to each cylinder 24 for timely introduction to the combustion chamber 68 defined between the pistons 62, 64 in each set of pistons 60.

The ports 160 and 170 in the axial cylinders 24 are in the form of slots around the circumference of the cylinder 24. The exhaust and inlet ports 160 and 170, respectively, are so disposed except at the inner portion of the piston circumference say 60 degrees (inner, meaning the portion of the circumference closest to the axis of rotation), in that embodiment described above where the groove 142 in the skirt 66" of each piston is disposed and the ends of the piston rings 77 are sliding back and forth.

In the embodiment shown by way of example in FIG. 16, the annular exhaust cavities 162 are cast and cored individually in the engine housing 12 and connect directly to the source of pressurized air 30, i.e., the turbo-charger. As shown in FIGS. 3 and 16, an axially elongated cylindrical sleeve 158 is preferably shrink fit into the engine housing 12 about the centershaft 17 of the shaft assembly 14 and serves to keep the various annular cavities separated from each other.

Figure 17:
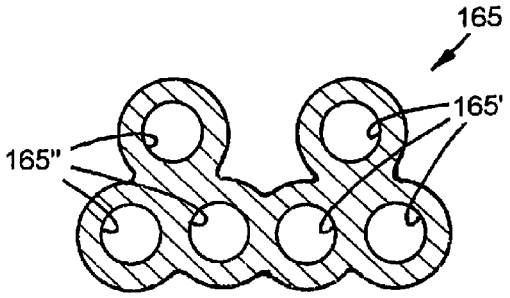
FIG. 17 is a sectional view of one form of exhaust manifold for the engine taken along line 17-17 of FIG. 3.

FIG. 17 is a schematic cross-section of one form of exhaust manifold, indicated generally by reference letter numeral 165, carried by the engine housing 12. The cored passages 162 extend circumferentially about each cylinder 24 and lead to the exhaust manifold 165 and, ultimately, to the turbo charger 30. As mentioned, the passages 162 are alternating to one side or the other side of the turbo charger 30. Thus, the passages marked by reference numeral 165' in FIG. 17 connect to one side of the turbo charger 30 while those passages marked by reference numeral 165" in FIG. 17 connect to the other side of the turbo charger 30. As such, any interference in the gas exchange of one cylinder 24 with respect to the gas exchange of adjacent cylinders is minimized.

In the embodiment shown by way of example in FIG. 16, each cylinder 24 includes slots or ports 166 which are disposed at an angle from the radial position to direct the exhaust flow towards one of the cored passages 164. As such, the kinetic energy of the exhaust is conserved. as much as possible. In the illustrated embodiment, a portion of the circumference of each cylinder 24 is preferably not machined to allow the piston rings 67 and piston ring groove 67' (FIG. 4) on each piston 62, 64 to reciprocate and slide back and forth without interruption. In the illustrated embodiment shown in FIG. 16, the uninterrupted portion of the circumference of each cylinder 24 is preferably disposed towards the center of rotation.

Returning again to FIG. 3, and in a preferred form of the invention disclosure, the annular intake cavities 172 are connected to a torus-like cavity 174 which surrounds the main housing 12 and acts as a reservoir for the source of pressurized air 30.

In the illustrated embodiment shown by way of example in FIG. 3, annular cavities 176, 177 and 178 are defined by the engine housing 12 and are interconnected to circulate cooling liquid through the engine housing. As shown, the annular cavity 178 is preferably arranged in surrounding relation relative to the seal structure 150 to inhibit damage thereto resulting from excessive heat from high exhaust temperatures. Annular cavities 176 and 177 are preferably arranged in surrounding relation to the injection ports to protect the injectors 177' from excessive heat.

In the embodiment illustrated in FIG. 3, engine 10 is furthermore provided with a lubrication system 180. In the embodiment illustrated by way of example in FIG. 3, the lubrication system 180 includes, in part, a series of interconnected passages defined by engine housing 12 so as to permit lubricant to be circulated in a manner cooling the seal structure 150 at the intake side and lubricating various related sliding surfaces within the engine 10. In the illustrated embodiment shown by way of example in FIG. 3, pressurized lubricant enters the engine housing 12 through a suitably disposed inlet port 178*a*. The lubricant inlet port 178*a* is fluidically connected to a pump 185 which, in turn, draws lubricant from a sump 185'. From the inlet port, pressurized lubricant passes into the lubrication system 180 of engine 10. For example, after passing through the inlet port, pressurized lubricant is directed to a passage 188 in the shaft assembly 14 for distribution throughout the engine.

In the embodiment illustrated by way of example in FIG. 3, from the lubricant passage 188 in shaft assembly 14, lubricant flows to a radially directed passage 190 which is in fluid communication with an annular passage 191 defined by each angular crank 16, 16' so as to lubricate rolling contact bearings 48 and 50 of bearing assembly 47. Moreover, the lubrication system 180 directs lubricant to another lubricant passage 192 defined in the non-rotating disc 44, and to each spherical socket 112 defined in the non-rotating disc 44. Suitable rotating seals on each angular crank 18, 18' and on thrust washers of the rolling contact bearing 50 limit the lubrication fluid from leaking into the end housing 22, 22' During operation of the engine, lubricant substantially surrounds the second ball joint 78' disposed toward the end of the piston rod assembly 76. Having the spherical element 83' tightly held against the socket 112 defined by the non-rotating disc 44 by the retainer 100 furthermore minimizes lubricant leakage into the respective end housing.

In the preferred embodiment shown in FIGS. 4 and 9, lubricant flows through the tube 81 of the piston rod assembly 76 to the bearing surface between ball joint 78 and the spherical socket 72 defined by the respective piston at an opposite end of the piston rod assembly 76. In the example set forth in FIG. 4, pressurized lubricant flows from the tube 81 into and through the generally centralized opening 97*e* defined by spacer 90. From opening 97*e*, pressurized lubricant flows radially outward though the lubricant passages 97*a*, 97*b*, 97*c* and 97*d* (FIG. 10) toward the piston head 66 to cool the respective piston. Lubricant also flows into the grooves 96*a*, 96*b*, 96*c* and 96*d* (FIG. 10) about the circumferential edge of the spacer 90 to cool the respective piston head 66 of the respective piston. From piston head 66, lubricant flow is directed through the groovers 96*a*, 96*b*, 96*c* and 96*d* (FIG. 10) into and through the aligned series of axially elongated and open-ended grooves 106*a*, 106*b*, 106*c* and 106*d* (FIG. 12) in retainer 100. Ultimately, the lubricant flows into the respective end housing 22 from whence lubricant is returned to the lubricant sump 185'.

During assembly of the engine 10 having a shaft assembly 14 including a centershaft 17 and angular crank portions 18, 18', a measurement is made between the tops of the respective pistons with a suitable tool inserted thru opening 176 in the engine housing 12, which later accepts the injection nozzle or sparkplug 177. Based on such measurement, the shims 19' are added or removed between the centershaft 17 and the respective angular crank portion 18' to arrive at the proper distance between the opposed pistons 62, 64.

Preferably, the shims 19 are selected as follows. As shown in FIG. 3, a measurement from surface "S" at a rear of the angular crank portion 18 to a mounting surface "G" on the main or center shaft 17 is first recorded. The distance between point "B" (FIG. 1), where the path of the ball joints 78 on the non-rotating disc 44 intersect with the longitudinal axis 15, and the surface "S" on the rear of angular crank shaft portion 18 has already been recorded at the time of machining the shaft assembly 14. The distance from the apex of the bevel gear 55' to the bevel gear mounting surface on housing 12 has also been recorded at the time of machining the bevel gear 55'. Using these three recorded dimensions, (one measurement and two recorded distances), the thickness of the shims 58 is computed. The design of the conical surface bearings 52, 52' is closely held to the pitch cone of the bevel gear 55' at the time of manufacturing, and therefore it will also intersect point "B".

Next, the bevel gear-conical surface bearing assembly 55' is installed along with indexing dowel, shims 58' and fastener 57. The thickness of the shims 58' is selected to provide a slight contact between abutting faces of the conical surface bearings 52, 52'.

Thereafter, the remaining ball joints 78' are installed into their respective sockets 112 in the non-rotating disc 44. After an accessory gear 179 and bearing 20 (FIG. 1) have been installed onto opposed ends of shaft assembly 14, the cap or end housing 22 including a bearing cup, seal, and suitable "O"-ring assembly 23 is secured to the engine housing 12 using suitable fasteners 25, i.e., bolts or the like (FIG. 3), so as to clamp shims 27 against the flange of the bevel gear-conical bearing surface assembly 55' and the engine housing 12.

The shims 27 are selected to obtain the proper endplay on the bearing 20. It will be appreciated, the torque on the bevel gear 55 is transmitted to the engine housing 12 through friction due to the clamping force from the bolts 25.

In the form of the invention disclosure shown in FIG. 3, a hub 199 with a suitable key 199' and a balancing flywheel 199" can be provided for rotation with the shaft assembly 14. Alternatively, there can be a connection to a power take-off on one side and a connection to a belt pulley on the other side, if so desired.

Figure 18:
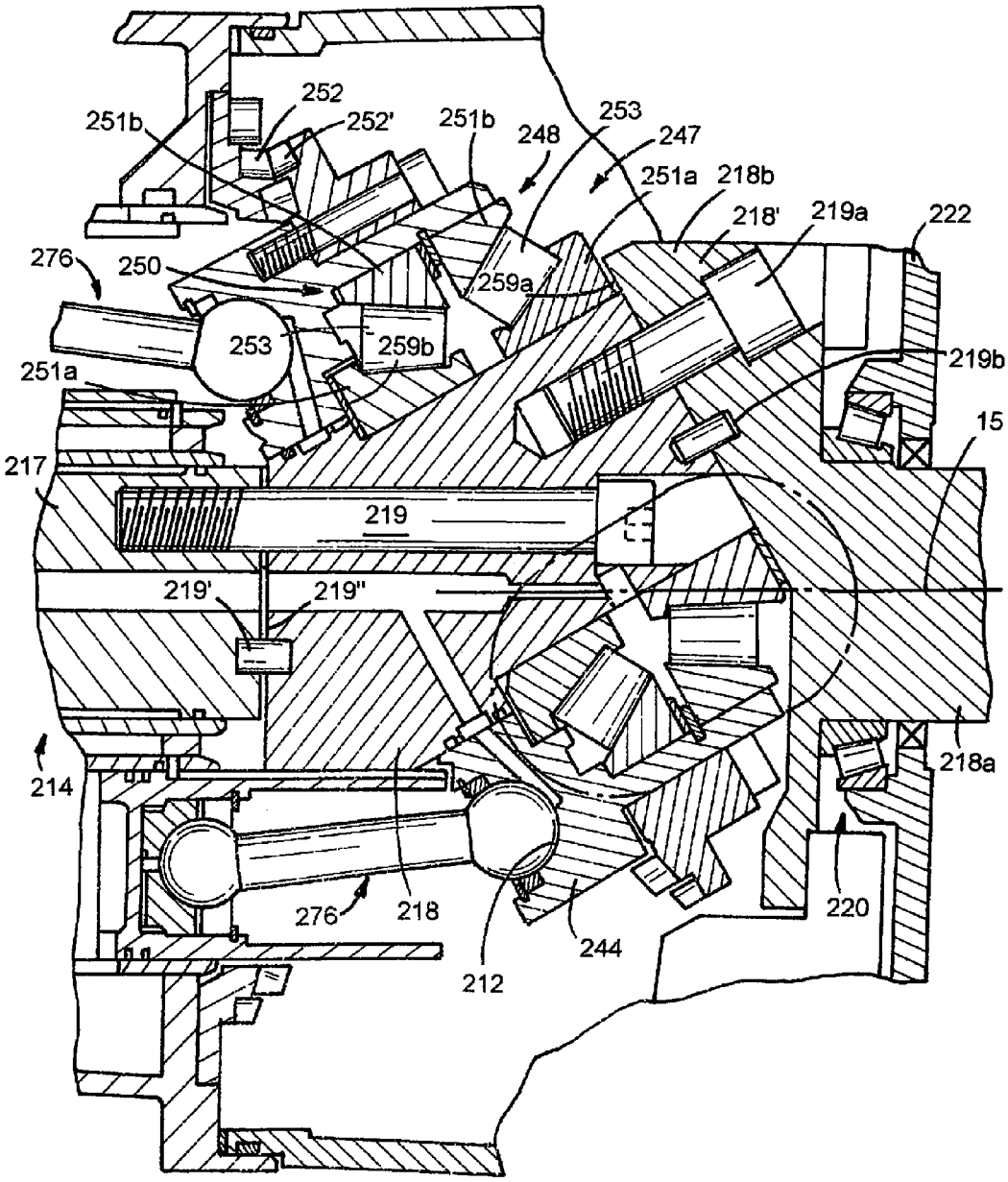
FIG. 18 is a fragmentary view similar to FIG. 3 but showing an alternative bearing arrangement for the engine of the present invention disclosure.

FIG. 18 illustrates an alternative form for the bearing arrangement used to operably interconnect the rotating surface with the non-rotating surface of the swash plate mechanism. This alternative form of bearing arrangement is designed generally b reference numeral 247. The elements of this alternative bearing arrangement and associated swash plate mechanism that are functionally analogous to those components discussed above regarding bearing arrangement 47 and related components are designed by reference numerals identical to those used above, with the exception this alternative embodiment uses reference numerals in the 200 series.

To facilitate assembly, this alternative bearing arrangement requires changes to the shaft assembly 214. In this regard, and in the embodiment shown in FIG. 18, shaft assembly 214 includes an axially elongated centershaft 217 with an angular crank portion 218 releasably secured to opposite ends thereof (with one one end of the centershaft being shown). In this embodiment, an end shaft portion 218' having an axial hub 218*a* and a radial attachment flange 218*b* is releasably secured to and for rotation with the angular crank portion 218. Notably, the axial hub 218*a* of end shaft portion 218" is axially aligned with but extends in axial direction away from the centershaft 217. The axial hub 218*a* of shaft assembly 214 rotatably supports shaft assembly 214 as well as the respective swash plate mechanism.

The angular crank portions 218 of shaft assembly 214 are releasably connected or conjoined to opposite ends of the centershaft 217 by suitable fasteners 219. In the illustrated embodiment, the fasteners 219 pass through the respective crank portion 218 to releasably secure the respective crank portion to an end of the centershaft 217. Prior to securing each crank portion 218 to an end of the centershaft 217, suitable dowels 219' and one or more shims 219" are installed between the respective angular crank portion 218 and the centershaft 217. The dowels 219' (with only one being shown) align the angular crank portions 218 with the centershaft 217 and determine the lag angle, preferably about 40 degrees, between the exhaust side and the intake side of the engine 10 (in operation of the engine, the dowels 219' also transmit torque). The largest portion of the torque, however, is transmitted through friction between the crankshaft 217 and angular crank portions 218. In one form, the shims 219" disposed between the respective angular crank portion 218 and the centershaft 217 serve the same purpose as shims 19" described above.

The end shaft portion 218' is releasably connected or conjoined to the free end of the angular crank portion 218 of shaft assembly 214 by a suitable fasteners 219*a* passing through the radial attachment flange 218*b* on the end shaft portion 218'. Prior to securing each end shaft portion 218' to a free end of the angular crank portion 218, one or more suitable dowels 219*b* are installed between the respective angular crank portion 218 and the radial attachment flange 218*b* of end shaft portion 218' to promote transference of torque therebetween.

In engines with higher power capacity, the alternative form for the bearing arrangement 247 is preferably used. In the alternative bearing arrangement 247 illustrated in FIG. 18, first and second axially aligned rolling contact bearings 248 and 250 are both mounted on and about the crank shaft portion 218' of shaft assembly 214 at a greater distance from the longitudinal axis 15 than is the center of the circular array of ball joint sockets 212 in the non-rotating disc 244 to permit installation of a higher capacity second rolling contact bearing 250 while also providing a relatively large distance between the effective centers of the bearings 248, 250. In the illustrated embodiment, the rolling contact bearings 248 and 250 are of the same design. It will be appreciated, however, the bearings 248, 250 can be of different designs from each other without detracting or departing from this aspect of the present invention disclosure. In the illustrated embodiment, each bearing 248, 250 has an inner race 251*a*, an outer race 251*b* and a rolling element 253 disposed therebetween.

Figure 19:
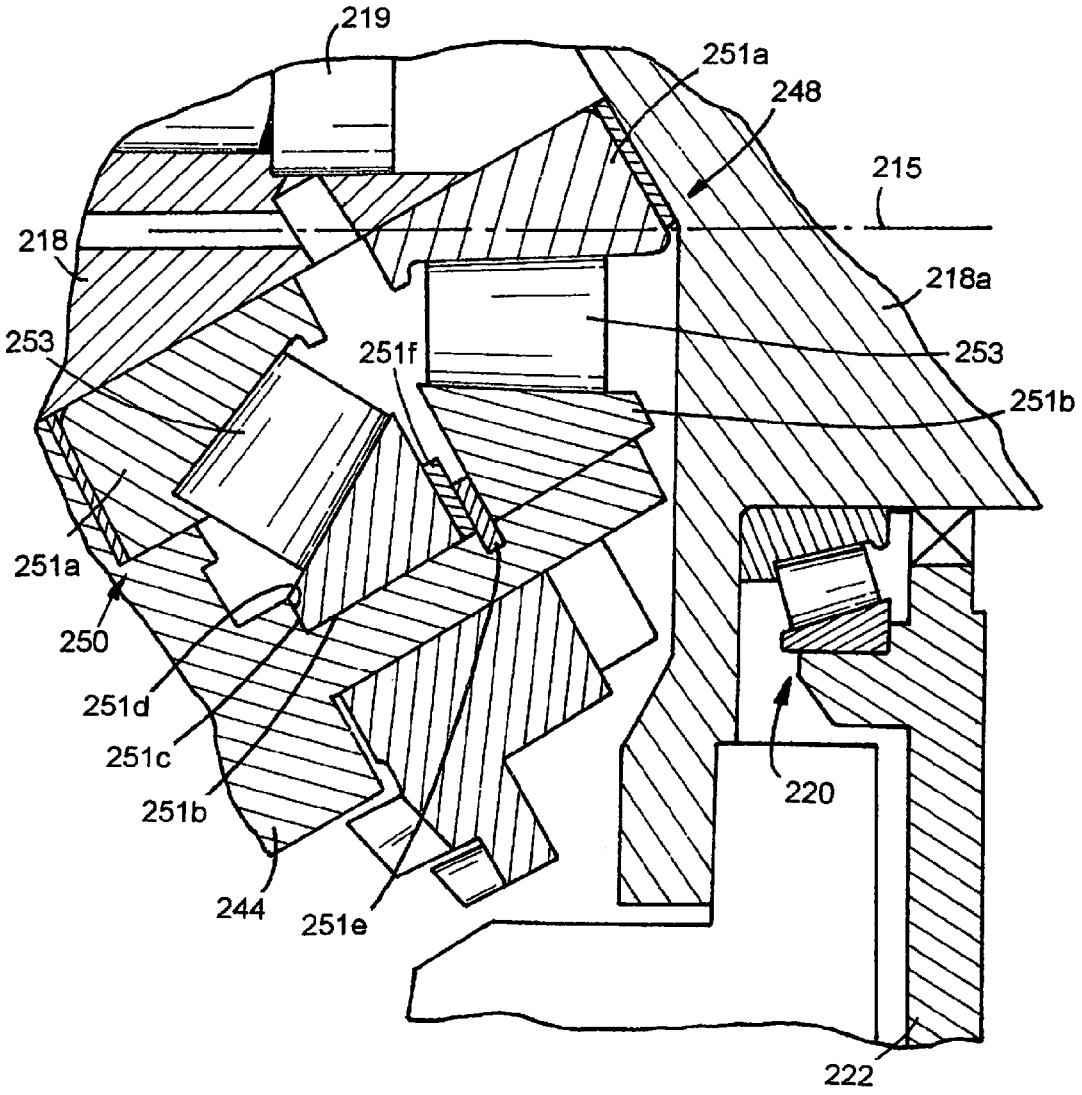
FIG. 19 is an enlarged view of the area encircled in phantom line in FIG. 18.

As shown by way of example in FIG. 19, an annular face 251*c* of bearing 250 disposed toward an outer edge of the outer race 251*b* of bearing 250 to abut and contact with a radial shoulder 251*d* defined by the non-rotating disc 244 of the respective swash plate mechanism. Moreover, a retaining ring 251*e*, carried by the non-rotating disc 244, is disposed between the outer races 251*b* of the first and second bearings 248, 250. Preferably, shims 251*f* are disposed between retaining ring 251*e* and the outer race 251*b* of the first bearing 248 so as to locate the the outer race 251*b* of bearing 250 against the radial shoulder 251*d* of the non-rotating disc 244. By this design, piston loads are transmitted through the radial shoulder 251*d* on the non-rotating disc 244, to the outer race 251*b* of bearing 250, to the retaining ring 251*e*, and to the outer race 251*b* of the rolling contact bearing 248. This design advantageously limits relative axial movements between the non-rotating disc 244 and the angular crankshaft portion 218 during a load reversal at high speed and low power of the engine 10.

An effective center of the rolling contact bearing 250 is disposed relative to the longitudinal axis 215 of shaft assembly 214 such that the rolling contact bearing 248 is positioned and has the capacity to absorb relatively high levels of forces during engine operation. That is, the two rolling contact bearings 248, 250, by themselves, have sufficient capacity to carry the off-center loads produced by the multiple pistons sets during operation of the engine. As such, the conical surface bearings 252, 252' of each swash plate mechanism are preferably used only in engines operated at higher speeds.

Figure 20:
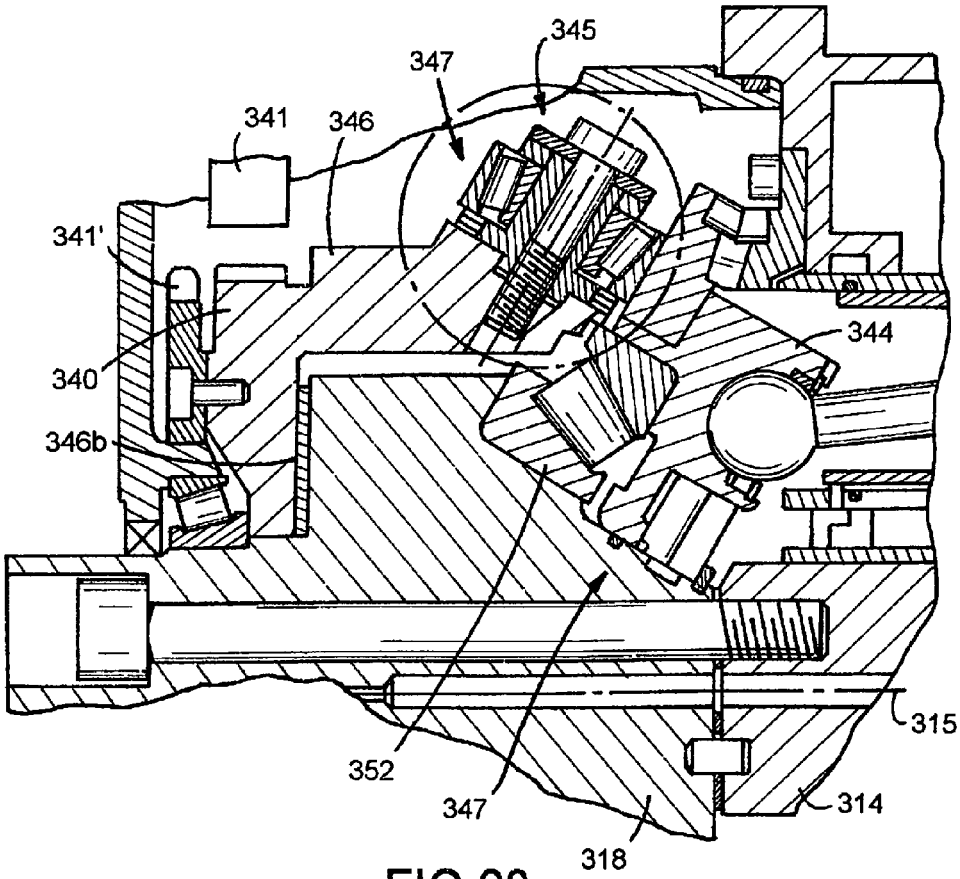
FIG. 20 is an enlarged view similar to FIG. 18 showing another alternative design.

FIG. 20 illustrates an alternative embodiment for the swash plate mechanism. More specifically, in the embodiment illustrated in FIG. 20, each swash plate mechanism of engine 10 is provided with a cam follower assembly for addressing the relatively high forces developed within an engine providing higher power. The cam follower assembly is designated generally by reference numeral 345. The elements of this alternative swash plate mechanism and associated components that are functionally analogous to those swash plate components discussed above are designed by reference numerals identical to those used above, with the exception this alternative embodiment uses reference numerals in the 300 series.

In the alternative embodiment illustrated in FIG. 20, the cam follower assembly 345 acts on a circular surface of the non-rotating disc 344 of the respective swash plate mechanism and shares the axial forces directed against the non-rotating disc with the first rolling contact bearing 352 of bearing arrangement 347 during engine operation. In the embodiment illustrated in FIG. 20, the cam follower assembly 345 is mounted or carried by a carrier 346 secured to and for rotation with the shaft assembly 314. Shims 346*b* suitably disposed between the carrier 346 and the angular crank 318 of each swash plate mechanism facilitate adjustment of the cam follower assembly 345 relative to the mating surface on the non-rotating disc 344.

Although only one cam follower assembly 345 is schematically illustrated by way of example in FIG. 20, it should be appreciated more than one cam follower assembly 345 is preferably arranged and mounted on carrier 346 in spaced radial and angular relation relative to the axis 315 of shaft assembly 314 and relative to each other. In those engine designs wherein more than one cam follower assembly is used, each cam follower assembly must be adjustably mounted to the carrier 346, in order to obtain zero clearance for all the cam follower assemblies.

Figure 21:
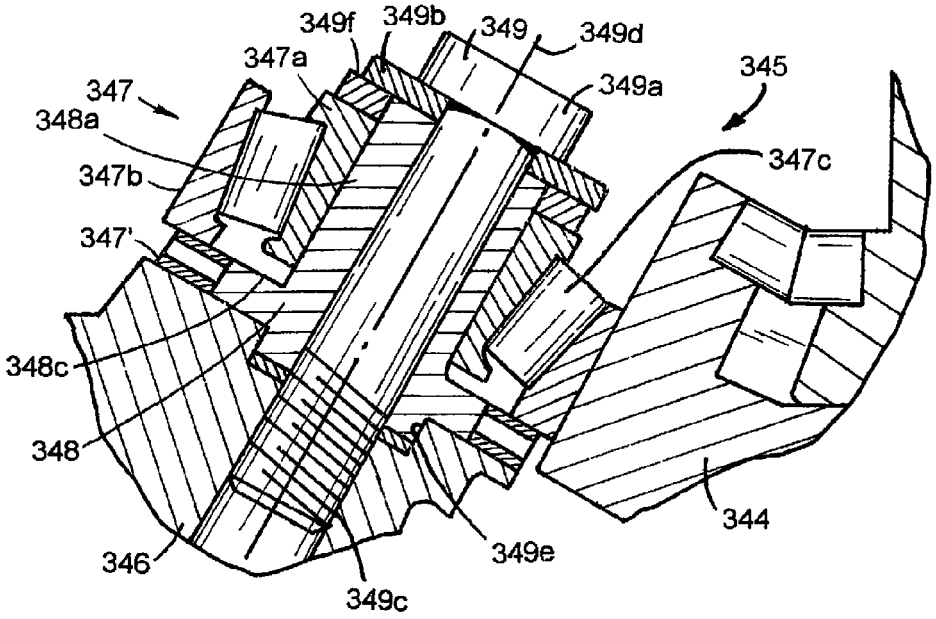
FIG. 21 is an enlarged view of the area encircled in phantom line in FIG. 20.

Turning to FIG. 21, each cam follower assembly 345 preferably includes a tapered rolling bearing 347 including an inner race 347*a* and outer race 347*b* and a rotating element 347*c* entrapped therebetween. Bearing 347 is positioned and arranged such that the centrifugal forces acting on the outer race 347*b* are transmitted as a thrust load to the bearing 347. In the embodiment illustrated in FIG. 21, each cam follower assembly 345 further includes a thrust bearing 347' arranged in operable combination with bearing 347. Thrust bearing 347' is arranged and mounted relative to bearing 347 such that bearing 347' operably carries the induced load from bearing 347 minus the centrifugal forces.

In the embodiment illustrated in FIG. 21, the bearing 347 of each cam follower assembly 345 is mounted on an eccentric 348 which is rotatable about a fastener 349 having an enlarged head portion 349*a* and washer 349*b*. An axially elongated threaded shank portion 349*c* extends from the head portion 349*a* and washer 349*b* for securing the cam follower assembly 345 to carrier 346. As shown, fastener 349 is disposed on and at an angle relative to the carrier 346. A pilot diameter 349*e* on the eccentric 348 defines an axis 349*d* about which the eccentric 348 can rotate. Notably, the axis 349*d* is disposed generally parallel to a face of the non-rotating disc 344 which abuts with and against which the cam follower assembly 345 presses during operation of the engine 10. In the embodiment shown by way of example, eccentric 348 has an elongated and hollow eccentric shaft portion 348*a* along with a flange 348*c* disposed toward one end of the carrier 346.

The eccentric 348 is clamped endwise onto the carrier 346 between the washer 349*b* on fastener 349 and the carrier 346. Endplay of the eccentric 348 along the length of the fastener 349 can be adjusted to zero through use of shims 349*f* disposed between the washer 349*b* and bearing 347.

The shims 349*b* (FIG. 20) disposed between the carrier 346 and the angular crank 318 of each swash plate mechanism facilitate a relatively course adjustment of the cam follower assembly 345 relative to the mating surface on the non-rotating disc 344. As will be appreciated, and as shown in FIG. 21, relative rotation of the eccentric 348 about axis 349*d* allows more precise adjustment and location of the cam follower assembly 345 relative to the mating surface on the non-rotating disc 344 of the respective swash plate mechanism.

In a preferred embodiment shown in FIG. 20, carrier 346 can also serve as balancing weight for the engine 10. Also, an as shown in FIG. 20, a sprocket gear 340 can be attached to the carrier 346. The engine 10 can further include a suitable sensor 341 (FIG. 20) arranged in operable combination with the sprocket gear 340 for monitoring the speed of the engine 10 and, with a proper design of the sprocket gear 340, the angular orientation of the engine 10 can also be readily determined. In a preferred form, another gear 341' can be suitably secured to the carrier 346. Gear 341' can be used to drive the pump 85 (FIG. 3) for supplying lubricating and cooling fluid to a lubrication system of the engine 10.

Figure 22:
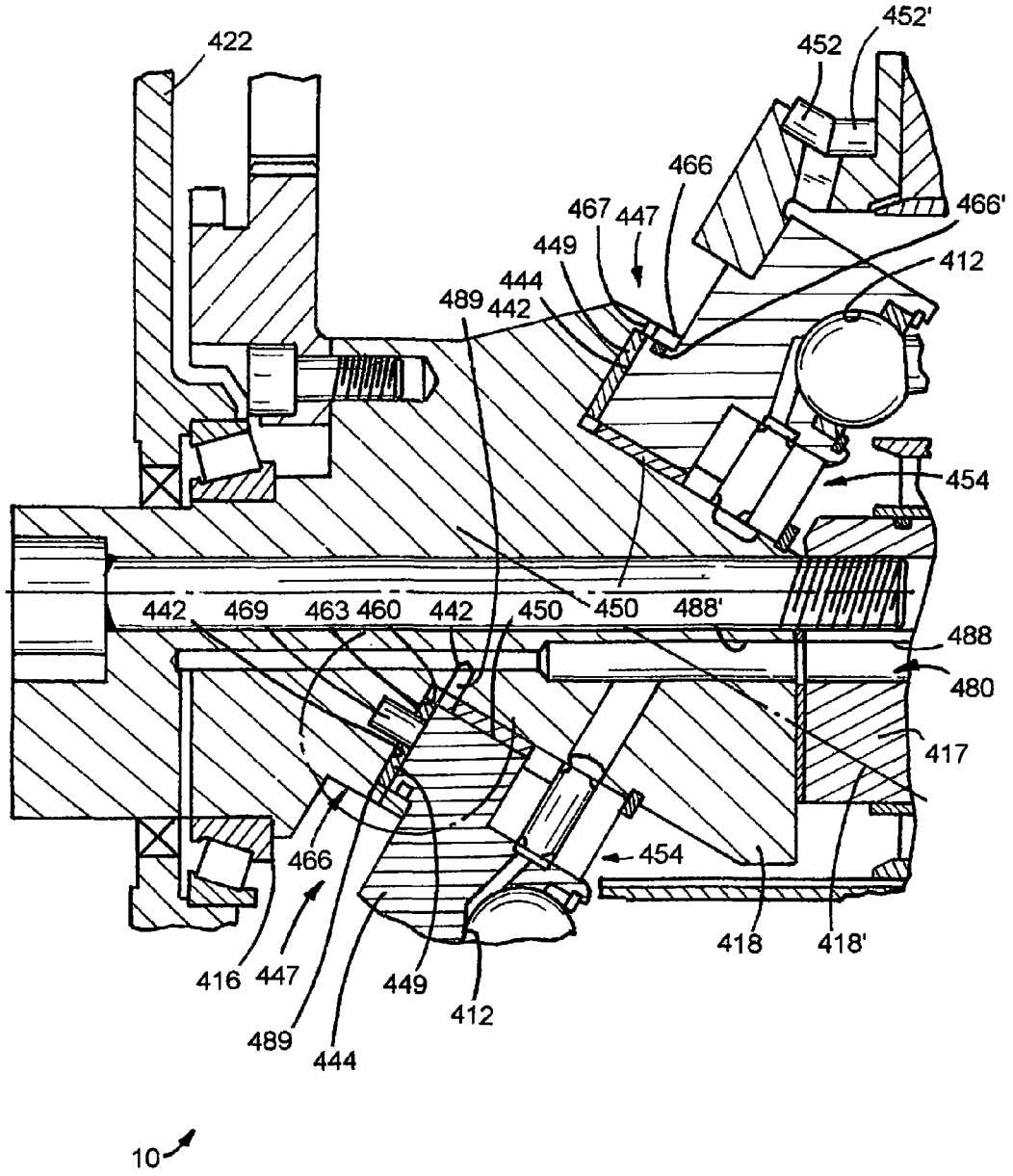
FIG. 22 is another fragmentary view similar to FIG. 3 but showing an alternative bearing arrangement for the engine of the present invention disclosure.

FIG. 22 illustrates yet another alternative form for the bearing arrangement used to operably interconnect the rotating surface with the non-rotating surface of the swash plate mechanism of engine 10 (FIG. 1). This alternative form of bearing arrangement is designed generally by reference numeral 447. The elements of this alternative bearing arrangement and associated swash plate mechanism that are functionally analogous to those components discussed above regarding bearing arrangement 47 and related components are designed by reference numerals identical to those used above, with the exception this alternative embodiment uses reference numerals in the 400 series.

In the embodiment illustrated in FIG. 22, the rotating surface 442 defined by the respective swash plate mechanism of engine 10 is in contact with the non-rotating disc 444 through a glide thrust bearing 449 arranged in operable combination with a journal bearing or bushing 450 and a rolling contact thrust bearing 454 (FIG. 22). The glide thrust bearing 449 is arranged behind the circular array of sockets 412 in the non-rotating disc 444 so as to transmit the thrust load between the rotating surface 442 and the non-rotating disc 444 on the respective swash plate mechanism.

One advantage in using this alternative form of bearing arrangement embodying glide thrust bearing 449 is that it substantially reduces the overall length of the engine 10 as compared to the other designs discussed above. Another advantage to be realized through use of this alternative form of bearing arrangement embodying glide thrust bearing 449 is that it expected to offer a lower production cost over the other designs discussed above. Still another advantage to be realized through use of this alternative form of bearing arrangement embodying glide thrust bearing 449 is that it allows higher engine speed limits as compared to the other engine designs discussed above As shown in FIG. 24, the glide thrust bearing 449 has a generally circular configuration, in plan, and defines an inner diameter 460 and an outer diameter 462. Moreover, and in the embodiment shown in FIGS. 25 and 26, the glide thrust bearing 449 has first and second major surfaces 463 and 463' extending generally perpendicular to the axis 418' of the respective angular crank portion 418. In the embodiment illustrated by way of example in FIGS. 25 and 26, the first major surface 463 of the glide thrust bearing 449 has a generally planar configuration and faces the rotating surface 442 of the angular crank on the respective swash plate mechanism. The other major face 463' of the glide thrust bearing 449 faces the non-rotating disc of the respective swash plate mechanism.

The glide thrust bearing 449 is arranged far enough behind the circular array of sockets 412 in the non-rotating disc 444 and is designed such that the outside diameter 462 of the glide thrust bearing 449 is large enough to maintain a line of action of the vector sum of all forces extending perpendicular to the glide thrust bearing 449 to be disposed radially inside of the outer diameter 462 of bearing 449.

Figure 23:
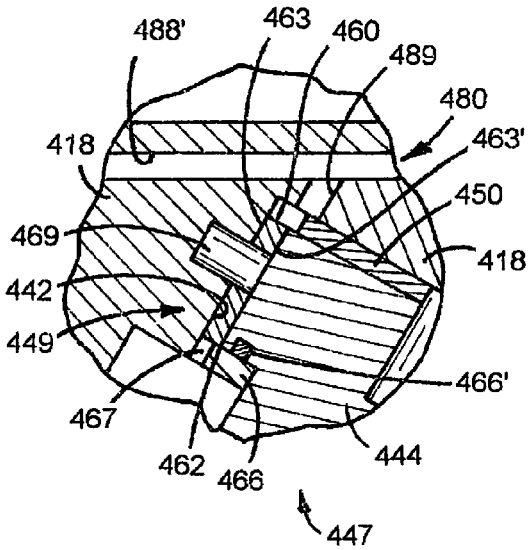
FIG. 23 is an enlarged view of the area encircled in a phantom line in FIG. 22.

As shown in FIG. 23, the needle bearing or bushing 450 is arranged about the angular crank 418 of the respective swash plate mechanism and is disposed toward the inner diameter 460 of the glide thrust bearing 449 to absorb the radial component of the piston forces applied thereto. Returning to FIG. 22, a combination of the conical surface bearing 452, 452' and the rolling contact thrust bearing 454 absorb acceleration forces at higher than normal operation speeds of engine 10 at no load conditions. In those application where engine 10 is intended to operate only at higher speeds (greater than 2550 rpm) the conical surface bearings 452, 452' can be used.

The thrust bearing 454 is arranged, located and assembled in the same manner as described above regarding rolling contact bearing 50. The conical surface bearings 452, 452 are arranged, located and assembled in the same manner as described above regarding conical surface bearings 52, 52'. In this embodiment, the angular crank portion 418 is releasably secured to a centershaft 417 in the same manner and similarly adjusted as was angular crank portion 18 to centershaft 17 discussed above.

Pressurized lubricant is provided between the rotating surface 442 and non-rotating disc 444 of each swash plate mechanism as well as to the glide thrust bearing 449 and the needle bearing or bushing 450 through lubrication system 480. In the illustrated embodiment, pressurized lubricant is provided to the glide thrust bearing 449 and the needle bearing or bushing 450 through the aligned passage 488, 488' in the centershaft 417 and the angular crank 418, respectively. From passage 488 pressurized lubricant flows into passage or orifice 489 defined in the angular crank 418. The needle bearing or bushing 450 is provided with lubricant from the annular cavity 491.

As shown in FIGS. 22 and 23, the crank portion 418 defines a cylindrical protrusion 466 which, in the illustrated embodiment, extends toward the non-rotating disc 444. As shown by way of example in FIG. 23, a seal 466' preferably carried by the non-rotating disc 444 preferably seals against an inner diameter of cylindrical protrusion 466 in surrounding relation relative to the outer diameter 462 of the glide thrust bearing 454.

As shown by way of example in the embodiment illustrated in FIGS. 22 and 23, the cylindrical protrusion 466 on the angular crank portion 418 defines an orifice 467 having or otherwise offering a predetermined flow rate of lubricant therethrough. As such, as pressured lubricant is provided to the glide thrust bearing 449 a predetermined amount of such lubricant is purposely permitted to escape from the glide thrust bearing 449 through the orifice 467 in the cylindrical protrusion 466. Suffice it to say, the orifice 467 defined by the cylindrical protrusion 466 is large enough to allow some lubricant to flow therethrough for sufficient cooling yet small enough to keep the glide thrust bearing 449 and the needle bearing or bushing 450, flooded with lubricant at all engine operating conditions.

In the embodiment illustrated in FIGS. 22 and 23, one or more pins 469 are arranged in combination with and orientate the glide thrust bearing 449 with respect to the non-rotating surface 444 of the respective swash plate mechanism. That is, the one or pins 469 cause the glide thrust bearing 449 to rotate with the rotating surface 442 on the angular crank during operation of engine 10. As such, the glide thrust bearing 449 maintains a relatively constant disposition to the forces applied thereagainst during operation of the engine 10.

In this regard, other preferred features of the glide thrust bearing 449 will now be discussed in connection with FIGS. 24, 25 and 26. In the embodiment illustrated in FIG. 24, the face 463' of the glide thrust bearing 449 is compartmentalized into high and low areas. More specifically, those areas or zones generally identified by reference numeral 470 are located in those areas or zones of the glide thrust bearing 449 exposed or subjected to relatively high loads. Those areas or zones generally identified by reference numerals 472 are located in those areas or zones of the glide thrust bearing 449 exposed or subjected to relatively low loads during engine operation. Each area or zone 470 is adjacent to a zone 478 which feeds lubricant to zone 470.

In general, and in connection with FIG. 25, those angularly spaced areas or zones 470 on the bearing 449 which are exposed or subjected to relatively high loads are disposed closer to the non-rotating disc 444 and extend parallel to the sweeping motion of the mating surface of the bearing 449 as compared to those angularly spaced areas or zones 472 on the bearing 449 which are exposed or subjected to relatively low loads and are disposed a further distance from the non-rotating disc 444. Because the areas or zones 472 are disposed a further distance from the non-rotating disc 444, they tend to collect lubricant therewithin.

In the embodiment illustrated in FIG. 24, the angularly spaced areas or zones 470 are arranged adjacent to the angularly spaced areas or zones 472. Moreover, and as shown in FIGS. 24 and 25, surface 463' of bearing 449 is provided with a series of angularly spaced and segmented outer and inner rings 474 and 476, respectively. As shown in FIG. 25, the angularly spaced and segmented outer and inner rings 474 and 476, respectively, are disposed at the same level or height as those areas or zones generally identified by reference numeral 470 and are bounding the zones 472 at the inner and outer diameter of the surface 463'. Notably, the area or zone 470 on bearing 449 are sufficiently sized to address the loads applied thereto. The angularly spaced areas or zones 472 are angularly located between angularly spaced areas 470 and 478, and carry no load while concomitantly reducing the overall viscous drag on bearing 449 during operation of the engine 10. As such, lubricant can flow through areas 478 from the inner diameter 460 to the outer diameter 462 of bearing 449 and from there to the orifice 467.

In a preferred embodiment shown in FIGS. 24 and 26, bearing 449 furthermore defines edges 480 located between the areas 472 and 478, which are at a level between the levels 470 and 472.

Levels 478 extend or ramp up from the edge 480 to the higher areas or zones along an upwardly inclined angle or ramp identified generally by reference numeral 478. In a preferred embodiment, such ramp or incline 478 is disposed between the angularly spaced and segmented outer and inner rings 474 and 476, respectively, on the glide thrust bearing 449. Thus, and during operation of engine 10 (FIG. 1), lubricant in the lower stress areas or zones 472 is swept toward the higher stress areas or zones 470 with a decreasing thickness whereby producing a hydrodynamic pressure on the lubricant film which is great enough to float the surfaces on the glide thrust bearing 449 out of contact with the abutting face on the non-rotating disc 444. Preferably, an uppermost surface on the outer and inner segmented bands 474 and 476, respectively, is disposed substantially planar with the high load areas or zones on the bearing 449, lubricant is inhibited from escaping toward inner and outer diameters 462, respectively of the glide thrust bearing 449.

From the foregoing, it will be observed that numerous modifications and variations can be made and effected without departing or detracting from the true spirit and novel concept of this invention disclosure. Moreover, it will be appreciated, the present disclosure is intended to set forth an exemplifications which are not intended to limit the disclosure to the specific embodiments illustrated. Rather, this disclosure is intended to cover by the appended claims all such modifications and variations as fall within the spirit and scope of the claims.

What is claimed is:

1. An internal combustion engine, comprising:

a main housing;

an axially elongated shaft assembly arranged in said housing for rotation about a fixed longitudinal axis, with said shaft assembly having first and second longitudinally spaced angular cranks;

first and second swash plate mechanisms arranged in axially spaced relation relative to each other, with said first swash plate mechanism being operably associated with said first angular crank of said shaft assembly, and with said second swash plate mechanism being operably associated with the second angular crank of said shaft assembly, with each swash plate mechanism having a rotating surface which rotates with the respective angular crank upon rotation of said shaft assembly, a set of two bevel gears with intermeshing teeth, a set of annular conical surface bearings, and a non-rotating disc, with said non-rotating disc being in contact with said rotating surface through first and second rolling contact bearings, and with said non-rotating disc defining a plurality of spherical sockets arranged in a circular array for accepting and holding therewithin a first ball joint disposed toward a first end of a series of piston rod assemblies, with a center of said circular array being disposed on said longitudinal axis, and with a plane of the circular array being arranged parallel to the rotating surface of the respective swash plate mechanism;

multiple axial cylinders arranged in a circular array within said housing, with said cylinders being radially and angularly spaced from said longitudinal axis and between said first and second swash plate mechanisms;

a plurality of piston sets, with each piston set including first and second pistons arranged in each axial cylinder for reciprocal movements in opposed directions relative to each other, with the first piston of each piston set being operably connected to said first swash plate mechanism by one of said series of piston rod assemblies, and with said second piston in each piston set being operably connected to said second swash plate mechanism by one of said series of piston rod assemblies, with the pistons in each piston set defining a spherical socket which accepts and holds therewithin a second ball joint disposed toward a second end of the series of piston rod assemblies, and with the pistons in each piston set including a piston head forming part of a combustion chamber;

with said shaft assembly operably maintaining a fixed angular index between said first and second swash plate mechanisms;

a pair of end housings operably secured to said main housing, with each end housing rotatably supporting said shaft assembly;

a mechanism for producing a forced stream of air;

a system operably associated with said mechanism for injecting fuel through an inlet port defined by said housing and into each cylinder; and a pump for supplying lubricating and cooling fluid to a lubrication system.

2. The internal combustion engine according to claim 1, wherein each piston rod assembly includes an elongated connector extending between and connected to one of said ball joints disposed toward opposed ends thereof.

3. The internal combustion engine according to claim 2, wherein the elongated connector of each piston rod assembly is configured as a tube which passes endwise through a hollow rod which passes through a first retainer operably associated with said piston and a second retainer operably associated with said non-rotating disc, and with tube defining an axially elongated passage which opens at opposed ends thereof, with said tube being operably connected toward each end to one of sad ball joints whereby entrapping said connector therebetween.

4. The internal combustion engine according to claim 3, wherein said first retainer operably holds the ball joint at one end of a respective piston rod assembly in operable association within the spherical socket defined by one of said pistons while said second retainer holds the ball joint at the opposed end of the respective piston rod assembly in operable association with said non-rotating disc, with each retainer having a spherical surface configuration on a first side thereof that contacts a respective ball joint, and a generally flat surface on a second side contacting a retaining ring operably fit into a groove on each of said pistons and said non-rotating disc.

5. The internal combustion engine according to claim 4, wherein said retaining ring is selected from a group of retaining rings with a variety of thicknesses so as to produce a sung fit in each ball joint.

6. The internal combustion engine according to claim 1, wherein thrust and radial loads between said rotating surface and said non-rotating disc of each swash plate mechanism are carried by said first rolling contact bearing disposed therebetween in conjunction with the second rolling contact bearing which absorbs the imbalance of forces from the first rolling contact bearing disposed between said rotating surface and said non-rotating disc.

7. The internal combustion engine according to claim 6, wherein said first rolling contact bearing is disposed a greater distance from said longitudinal axis than are the spherical sockets on said non-rotating disc such that a diameter of said first rolling contact bearing is not constrained by the spherical sockets on said non-rotating disc, and a line of action of resultant forces from said each piston set is disposed proximate to an effective center of said first rolling contact bearing whereby minimizing moments about the effective center of said first rolling contact bearing.

8. The internal combustion engine according to claim 6, wherein said set of conical surface bearings include two annular conical surface bearings for absorbing a majority of the sum of moments at higher than normal engine speeds, with a first of said annular conical surface bearings being operably attached to said housing and concentrically arranged relative to said longitudinal axis, and with a second of said annular conical surface bearings being attached to said non-rotating disc and concentrically arranged relative to an axis of relative rotation between said rotating surface and said non-rotating disc, with said first and second annular contact bearings operably contacting each other at a line passing through an intersection of said longitudinal axis and the axis of relative rotation between said rotating surface and said non-rotating disc.

9. The internal combustion engine according to claim 1, wherein said set of bevel gears of each swash plate mechanism keep said non-rotating disc from rotating, with a first bevel gear in said set of bevel gears being concentrically arranged relative to said longitudinal axis and is operably secured to said housing, and with a second bevel gear in said set of bevel gears being concentrically arranged relative to an axis of relative rotation between said rotating surface and said non-rotating disc and is operably secured to said non-rotating disc, and wherein said set of bevel gears are arranged relative to each other such that their apex coincides with an intersection between said longitudinal axis and the axis of relative rotation between said rotating surface and said non-rotating disc.

10. The internal combustion engine according to claim 9, wherein a diameter of said first and second bevel gears in each set of bevel gears operably surrounds the respective swash plate mechanism.

11. The internal combustion engine according to claim 1, wherein the conical surface bearings of each swash plate mechanism are operably secured to the respective set of bevel gears such that a contact line of said conical surface bearings is in line with a pitch cone of said bevel gears.

12. The internal combustion engine according to claim 1, wherein the shaft assembly includes an axially elongated centershaft with the angular cranks being releasably secured to opposed ends of the centershaft.

13. The internal combustion engine according to claim 12, wherein one or more fasteners axially pass through each angular crank to releasably secure the respective angular crank to an end of said centershaft.

14. The internal combustion engine according to claim 12, wherein the angular crank of said shaft assembly is adjustably secured to said centershaft to allow an axial distance between the juxtaposed ends of said first and second piston heads to be adjusted whereby modifying the volume of said combustion chamber.

15. The internal combustion engine according to claim 1, wherein the piston head of each piston defines an inlet opening through which fuel passes from said injection fuel system for combustion during operation of said engine.

16. The internal combustion engine according to claim 15, wherein the inlet opening defined by each piston opens to a cylindrical edge of each piston, and wherein the angular disposition of said inlet opening defined by said piston corresponds to area between two adjacent openings in the respective cylinder so as to prevent premature opening of an inlet port and/or exhaust port, respectively, defined by said housing during operation of said engine.

17. The internal combustion engine according to claim 16, wherein a circumferential edge arranged toward a foremost end of said piston defines a series of angularly adjacent recesses, with the angular disposition of each recess about the circumference of said piston respectively corresponding to a radial distance between port openings defined by said housing whereby achieving an enhanced opening of the ports during operation of said engine.

18. The internal combustion engine according to claim 1, wherein the pistons in each piston set are angularly oriented relative to the respective axial cylinder through the first and second ball joints of each piston rod assembly.

19. The internal combustion engine according to claim 1, wherein the pistons in each piston set are angularly oriented relative to the respective axial cylinder by a pin carried by said cylinder, with said pin engaging and slidably moving within an axial recess defined by each of said pistons.

20. The internal combustion engine according to claim 1, further including seal structure for minimizing the amount of lubricant passing between each piston and the respective axial cylinder associated therewith and minimizing gas leakage entering either of said end housings.

21. The internal combustion engine according to claim 20, wherein said seal structure includes in operable combination a first ring, having a relatively low coefficient of friction and high wear resistance arranged within a groove defined by said cylinder, and a second elastomeric ring.

22. The internal combustion engine according to claim 21, wherein said main housing defines a series of annular inlet cavities arranged in surrounding relation relative to each axial cylinder for directing various fluids through said engine and a series of annular exhaust cavities.

23. The internal combustion engine according to claim 22, wherein a plurality of the series of annular inlet cavities defined by said housing are fluidically connected to a reservoir for compressed gases passing from said mechanism for producing a forced stream of air.

24. The internal combustion engine according to claim 22, wherein the series of annular exhaust cavities defined by said housing are separated from each other, with each annular exhaust cavity being individually connected to said mechanism for producing a forced stream of air such that adjacent axial cylinders are connected to opposed sides of said mechanism for producing a forced stream of air.

25. The internal combustion engine according to claim 22, wherein two sets of annular inlet cavities defined by said housing direct coolant about said axial cylinders, and wherein said two sets of annular inlet cavities for directing coolant about said axial cylinders are interconnected to each other.

26. The internal combustion engine according to claim 22, wherein one set of annular inlet cavities for directing coolant about said axial cylinders is arranged adjacent to one side of the set of intake cavities and adjacent on the other side to a first side of the set of exhaust cavities and surrounds the inlet port through which fuel enters the engine.

27. The internal combustion engine according to claim 26, wherein a second set of annular inlet cavities for directing coolant about said axial cylinders is disposed to a second side of the set exhaust cavities and at least partially surrounds said seal structure.

28. The internal combustion engine according to claim 22, further including a hollow sleeve arranged in generally coaxial and surrounding relation relative to said shaft assembly for operably separating the annular cavities from each other.

29. The internal combustion engine according to claim 1, wherein the piston in each piston set includes an insert defining at least a portion of the spherical socket defined by each piston, with said insert defining grooves which receive and distribute oil from said pump across an inside of the piston head of each set of pistons.

30. The internal combustion engine according to claim 1, wherein the ball joints of each piston rod assembly are lubricated by oil from said pump.

31. The internal combustion engine according to claim 1, wherein an effective center of said first rolling contact bearing is disposed relative to said longitudinal axis such that said second rolling contact bearing is positioned and has a capacity to absorb a high level of forces during engine operation.

32. The internal combustion engine according to claim 1, wherein said shaft assembly includes a centershaft rotatably arranged in the main housing, an angular crank shaft portion releasably secured to opposed ends of the crankshaft, and an end shaft portion axially extending away from and releasably secured to each angular crank shaft portion for rotatably supporting the respective swash plate mechanism.

33. The internal combustion engine according to claim 32, wherein at least one fastener passes through and releasably secures the angular crank shaft portion to an end of the centershaft, and wherein said end shaft portion is releasably secured to a respective angular crank shaft portion by at least one fastener passing through an area of said end shaft portion.

34. An internal combustion engine, comprising:

a main housing;

an axially elongated shaft assembly arranged in said housing for rotation about a fixed longitudinal axis, with said shaft assembly having first and second longitudinally spaced angular cranks;

first and second swash plate mechanisms arranged in axially spaced relation relative to each other, with said first swash plate mechanism being operably associated with said first angular crank of said shaft assembly, and with said second swash plate mechanism being operably associated with the second angular crank of said shaft assembly, with each swash plate mechanism having a rotating surface which rotates with the respective angular crank upon rotation of said shaft assembly, a set of two bevel gears with intermeshing teeth, a set of conical surface bearings, and a non-rotating disc, with said rotating surface being in contact with said rotating surface through first and second rolling contact bearings, and with said non-rotating disc defining a plurality of spherical sockets arranged in a circular array for accepting and holding therewithin a first ball joint disposed toward a first end of a series of piston rod assemblies, with said circular array being disposed on said longitudinal axis and in a plane arranged generally parallel with the rotating surface of the respective swash plate mechanism, and a cam follower assembly acting on a circular surface of the respective non-rotating disc, with said cam follower assembly sharing axial forces directed against said non-rotating surface with said first rolling contact bearing during engine operation, with said cam follower assembly being arranged on a carrier mounted to the crank shaft of each swash plate mechanism;

multiple axial cylinders arranged in a circular array within said housing, with said cylinders being radially and angularly spaced from said longitudinal axis and between said first and second swash plate mechanisms;

a plurality of piston sets, with each piston set including first and second pistons arranged in each axial cylinder for reciprocal movements in opposed directions relative to each other, with the first piston of each piston set being operably connected to said first swash plate mechanism by one of said series of piston rod assemblies, and with said second piston in each piston set being operably connected to said second swash plate mechanism by one of said series of piston rod assemblies, with the piston in each piston set defining a spherical socket which accepts and holds therewithin a second ball joint disposed toward a second end of the series of piston rod assemblies, and with the pistons in each piston set including a piston head forming part of a combustion chamber;

with said shaft assembly operably maintaining a fixed angular index between said first and second swash plate mechanisms;

a pair of end housings operably secured to said main housing, with each end housing supporting a respective one of said swash plate mechanisms;

a mechanism for producing a forced stream of air;

a system operably associated with said mechanism for injecting fuel through an inlet port defined by said housing and into each cylinder; and a pump for supplying lubricating and cooling fluid to a lubrication system.

35. The internal combustion engine according to claim 34, wherein the carrier of said cam follower assembly is adjustably secured to the respective angular crank.

36. The internal combustion engine according to claim 34, wherein each cam follower assembly is adjustable so as to move a center of rotation of said cam follower assembly relative to a respective carrier by an eccentric.

37. The internal combustion engine according to claim 34, wherein each cam follower assembly includes a tapered roller bearing assembly configured to address the centrifugal forces applied to said cam follower assembly during engine operation, and a thrust bearing disposed to address induced forces applied to said cam follower assembly during engine operation.

38. An internal combustion engine, comprising:

a main housing;

an axially elongated shaft assembly arranged in said housing for rotation about a fixed longitudinal axis, with said shaft assembly having first and second longitudinally spaced cranks;

first and second swash plate mechanisms arranged in axially spaced relation relative to each other, with said first swash plate mechanism being operably associated with said first angular crank of said shaft assembly, and with said second swash plate mechanism being operably associated with the second angular crank of said shaft assembly, with each swash plate mechanism having a rotating surface operably attached to one of said cranks at an angle with respect to said longitudinal axis, a set of two bevel gears with intermeshing teeth, a set of conical surface bearings, and a non-rotating disc, with said non-rotating disc being in contact with said rotating surface through a glide thrust bearing arranged in operable combination with a journal bearing and a rolling contact thrust bearing, and with said non-rotating disc defining a plurality of spherical sockets for accepting and holding therewithin a first ball joint disposed toward a first end of a series of piston rod assemblies, with the center of said circular array being disposed on said longitudinal axis and in a plane arranged generally parallel with the rotating surface of the respective swash plate mechanism;

multiple axial cylinders arranged in a circular array within said housing, with said cylinders being radially and angularly spaced from said longitudinal axis and between said first and second swash plate mechanisms;

a plurality of piston sets, with each piston set being arranged a second radial distance from the axis of said centershaft and includes first and second pistons arranged in each axial cylinder for reciprocal movements in opposed directions relative to each other, with the first piston of each piston set being operably connected to said first swash plate mechanism by one of said series of piston rod assemblies, and with said second piston in each piston set being operably connected to said second swash plate mechanism by one of said series of piston rod assemblies, with the piston in each piston set defining a spherical socket which accepts and holds therewithin a second ball joint disposed toward a second end of the series of piston rod assemblies, with each piston in each piston set including a piston head which forms part of a combustion chamber;

with said shaft assembly operably interconnecting the angular cranks to each other while maintaining a fixed angular index between said first and second swash plate mechanisms;

an end housing operably secured to said main housing, with each end housing supporting a respective one of said swash plate mechanisms;

a mechanism for producing a forced stream of air;

a system operably associated with said mechanism for injecting fuel through an inlet port defined by said housing and into each cylinder; and a pump for supplying lubricating and cooling fluid to a lubrication system.

39. The internal combustion engine according to claim 38, wherein said glide thrust bearing has a circular configuration, in plan, and defines an inner diameter and an outer diameter, and wherein a line of action of the vector sum of all forces extending in a direction perpendicular to the glide thrust bearing is disposed radially inside the outer diameter of said glide thrust bearing.

40. The internal combustion engine according to claim 39, wherein the first major surface of said glide thrust bearing has first angularly spaced portions disposed axially closer to said non-rotating disc than are adjacent second angularly spaced portions, with said second angularly spaced portions being disposed closer to said to said non-rotating disc than are adjacent third angularly spaced on the first surface of said glide thrust bearing, with the second angularly spaced portions defining ramp which is angled in the direction of rotation of said rotating surface from a lower level to a higher level, with the higher level on the second angularly spaced portions of said glide thrust bearing being disposed generally coplanar with the first angularly spaced portions so as to create a ramp effect, which creates, during operation of the engine, a hydrodynamic pressure of varying levels between the rotating surface and the non-rotating disc, and with the third angular spaced portions being located in angular relationship between said first and second angularly spaced portions and minimizing viscous drag on the glide thrust bearing and allows cooling lubricant to flow from the inside diameter toward the outside of diameter of the glide thrust bearing.

41. The internal combustion engine according to claim 38, further including a seal for inhibiting lubricant supplied to said glide thrust bearing from escaping from between said rotating surface and said non-rotating disc, and wherein said angular crank defines an orifice for controlling the flow of lubricant from between said rotating surface and said non-rotating disc.

42. The internal combustion engine according to claim 41, wherein the ramp defined by the second angularly spaced portions on said glide thrust bearing are bounded by limits disposed toward the inner an outer diameters of said glide thrust bearing, with said surface on said limits being disposed generally coplanar with the first angularly spaced portions on said lubricant along a length of said ramp toward said first angularly spaced portions on said glide thrust bearing.

43. The internal combustion engine according to claim 38, wherein said glide thrust bearing is orientated with respect to said rotating surface and has first and second major faces extending generally perpendicular to an axis of the respective angular crank, with the first face of said glide thrust bearing being compartmentalized into high load and low load areas.

* * * * *